US007736449B2

(12) United States Patent
Takada et al.

(10) Patent No.: US 7,736,449 B2
(45) Date of Patent: Jun. 15, 2010

(54) HIGH-STRENGTH HOT-DIP GALVANIZED STEEL SHEET AND METHOD FOR PRODUCING THE SAME

(75) Inventors: Yoshihisa Takada, Kitakyushu (JP); Masayoshi Suehiro, Futtsu (JP); Masao Kurosaki, Kitakyushu (JP); Hidekuni Murakami, Kitakyushu (JP); Hiroyasu Fujii, Kitakyushu (JP); Haruhiko Eguchi, Kitakyushu (JP); Hisaaki Sato, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 11/977,537

(22) Filed: Oct. 24, 2007

(65) Prior Publication Data

US 2008/0053576 A1 Mar. 6, 2008

Related U.S. Application Data

(62) Division of application No. 10/542,393, filed as application No. PCT/JP2004/000239 on Jan. 15, 2004, now Pat. No. 7,294,412.

(30) Foreign Application Priority Data

| | | |
|---|---|---|
| Jan. 15, 2003 | (JP) | 2003-007087 |
| Apr. 7, 2003 | (JP) | 2003-102488 |
| Apr. 14, 2003 | (JP) | 2003-109328 |
| May 2, 2003 | (JP) | 2003-127123 |

(51) Int. Cl.
*C23C 2/28* (2006.01)

(52) U.S. Cl. ..... 148/533

(58) Field of Classification Search ..... 148/320, 148/533

See application file for complete search history.

(56) References Cited

U.S. PATENT DOCUMENTS 6,517,955 B1 * 2/2003 Takada et al. ..... 428/659

(Continued)

FOREIGN PATENT DOCUMENTS

EP 1 160 346 A 12/2001

(Continued)

*Primary Examiner*—Roy King
*Assistant Examiner*—Jie Yang
(74) *Attorney, Agent, or Firm*—Kenyon & Kenyon LLP

(57) ABSTRACT

The present invention stably provides a high-strength hot-dip galvanized steel sheet having a high tensile strength and no non-plated portions and being excellent in workability and surface properties even when the employed equipment has only a reduction annealing furnace and a steel sheet containing relatively large amounts of Si, Mn and Al that are regarded as likely to cause non-plated portions is used as the substrate. The present invention: secures good plating performance even when the steel sheet contains Si, Mn and Al by adding Ni to a steel sheet, thus forming oxides at some portions in the steel sheet surface layer, and resultantly suppressing the surface incrassation of Si, Mn and Al at the portions where oxides are not formed; enhances the effect of Ni and accelerates the formation of oxides by further adding Mo, Cu and Sn; and moreover, in the case of a TRIP steel sheet, secures austenite by determining the ranges of Si and Al strictly, avoiding the deterioration of plating performance caused by the addition of Ni, and further adding Mo in a balanced manner.

In addition, the present invention, in a TRIP steel sheet, improves press formability by regulating a retained austenite ratio and accelerates the formation of oxides by regulating a hydrogen concentration and a dew point in annealing before plating.

10 Claims, 4 Drawing Sheets

U.S. PATENT DOCUMENTS

| | | | | |
|---|---|---|---|---|
| 6,558,815 | B1 | 5/2003 | Suzuki et al. | |
| 6,797,410 | B2 * | 9/2004 | Ishii et al. | 428/659 |

FOREIGN PATENT DOCUMENTS

| | | |
|---|---|---|
| JP | 64-079345 | 3/1989 |
| JP | 01-230715 | 9/1989 |
| JP | 02-217425 | 8/1990 |
| JP | 04-333552 | 11/1992 |
| JP | 04-346644 | 12/1992 |
| JP | 05-070886 | 3/1993 |
| JP | 05-247586 | 9/1993 |
| JP | 06-145788 | 5/1994 |
| JP | 07-034210 | 2/1995 |
| JP | 2000-050658 | 8/2000 |
| JP | 3 126 911 | 11/2000 |
| JP | 2001-131693 | 5/2001 |
| JP | 2002-047547 | 2/2002 |
| JP | 2002-234129 | 8/2002 |
| WO | 00/50658 | 8/2000 |
| WO | WO 01/34862 | 5/2001 |
| WO | WO 02/101112 | 12/2002 |

* cited by examiner

HIGH-STRENGTH HOT-DIP GALVANIZED STEEL SHEET AND METHOD FOR PRODUCING THE SAME

This application is a divisional application under 35 U.s.c. §120 and §121 of prior application Ser. No. 10/542,393 filed Jul. 14, 2005 now U.S. Pat. No. 7,294,412 which is a 35 U.S.C. §371 of International Application No. PCT/JP2004/000239 filed Jan. 15, 2004, wherein PCT/JP2004/000239 was filed and published in the English language.

TECHNICAL FIELD

The present invention relates to a hot-dip galvanized steel sheet used as a corrosion-resistant steel sheet for an automobile and the like, particularly to a steel sheet having a tensile strength of about 590 to 1,080 MPa and being excellent in stretchability at press forming, to which steel sheet Si, Mn and Al that are regarded as detrimental to plating performance are added. Here, plating performance includes both plating appearance and plating adhesiveness. Note that, hot-dip galvanized steel sheets intended in the present invention include an ordinary hot-dip galvanized steel sheet as a matter of course and also an alloyed hot-dip galvanized steel sheet subjected to heat treatment for alloying after the deposition of plating layers.

BACKGROUND ART

In recent years, there is more need for improvement in automobile fuel efficiency, as exemplified by the establishment of a new target for automobile fuel efficiency improvement and the introduction of tax privileges for low fuel consumption vehicles, as measures for reducing carbon dioxide emissions aimed at the prevention of global warming. The weight reduction of an automobile is effective as a means for improving fuel efficiency and, from the viewpoint of such weight reduction, a material having a higher tensile strength is strongly demanded. On the contrary, generally speaking, the press formability of a material deteriorates as the strength of the material increases. Therefore, the development of a steel sheet satisfying both press formability and high strength is desired in order to attain the weight reduction of such a member. There are an elongation measured by a tensile test, an n-value and an r-value as indices of formability. Nowadays, the simplification of a press process by integral forming is a current issue and therefore, among those indices, a large n-value that corresponds to a uniform elongation is being regarded as an important index.

Then, a hot-dip galvanized steel sheet is also required to have a higher tensile strength. In order to attain both a higher tensile strength and workability, it is necessary to add elements such as Si, Mn and Al. However, when such Si, Mn and Al are contained as components of a steel sheet, there arises a problem in that oxides that have poor wettability with a plating layer are formed during annealing in a reducing atmosphere, incrassate on the surface of the steel sheet and deteriorate the plating performance of the steel sheet. In other words, the elements such as Si, Mn and Al have a high oxidizability and for that reason they are preferentially oxidized in a reducing atmosphere, incrassate on the surface of a steel sheet, deteriorate plating wettability, generate so-called non-plated portions, and thus result in the deterioration of plating appearance.

In this light, in order to produce a high-strength hot-dip galvanized steel sheet, it is essential to suppress the formation of oxides containing Si, Mn, Al etc. as mentioned above.

From this point of view, various technologies have so far been proposed. For example, Japanese Unexamined Patent Publication No. H7-34210 proposes the method wherein a steel sheet is heated to 400° C. to 650° C. for oxidizing Fe in an atmosphere having an oxygen concentration in the range from 0.1 to 100% in the preheating zone of an annealing furnace of oxidization-reduction type equipment and thereafter subjected to ordinary reduction annealing and hot-dip galvanizing treatment. In this method however, since the effect depends on the Si content in a steel sheet, it is not said that plating performance is sufficient in the case of a steel sheet having a high Si content. Here, though there may sometimes be a state where non-plated portions are not formed if it is immediately after the formation of a plating layer, since the plating adhesiveness is insufficient, the problems of plating exfoliation and others may sometimes occur when various processing is applied to a hot-dip galvanized steel sheet after the formation of a plating layer. In other words, though Si addition is a requirement essential for the improvement of the workability of a steel sheet, such an amount of Si as necessary for the improvement of the workability cannot be added from the restrictions for securing plating performance by the aforementioned technology and therefore the technology cannot be a fundamental solution. Further, another problem of the technology is that the technology cannot be used in equipment having the capability of only reduction annealing since this method is applicable to only oxidization-reduction type equipment.

Meanwhile, though non-plated portions can also be avoided by applying reduction annealing and hot-dip plating in the state of forming Fe, Ni etc. on the surface of a steel sheet by electroplating beforehand, such a method requires additional electroplating equipment and causes an additional problem of the increase of the number of the processes and resultant cost increase.

Further, Japanese Patent No. 3126911 proposes the method wherein plating adhesiveness is improved by forming oxides at the grain boundaries of a steel sheet containing Si and Mn through a high temperature coiling at the stage of hot rolling. However, since this method requires a high temperature coiling at the stage of hot rolling, the problems thereof are: that pickling load after hot rolling increases as a result of the increase of oxidized scales, thus productivity deteriorates and resultantly the cost increases; that the surface appearance of the steel sheet deteriorates because grain boundary oxidization is formed on the surface of the steel sheet; and that the fatigue strength deteriorates with the grain boundary oxidized portions functioning as the origin.

Furthermore, for example, Japanese Unexamined Patent Publication No. 2001-131693 discloses the method wherein a steel sheet is annealed firstly in a reducing atmosphere having a dew point of 0° C. or lower, thereafter oxides on the surface of the steel sheet are removed by pickling, and subsequently the steel sheet is annealed secondly in a reducing atmosphere having a dew point of −20° C. or lower and then subjected to hot-dip plating. However, the problem of the method is that annealing must be applied twice and thus the production cost increases. Yet further, Japanese Unexamined Patent Publication No. 2002-47547 discloses the method wherein internal oxidization is formed in the surface layer of a steel sheet by applying heat treatment after hot rolling while black skin scales are attached to the steel sheet. However, the problem of the method is that a process for black skin annealing must be added and thus the production cost also increases.

Moreover, WO 00/50658 proposes the technology wherein Ni is added in an appropriate amount to a steel containing Si and Al. However, the problem caused by the technology is that, when the technology is intended to be applied to practical production, the plating performance varies with a reduction annealing furnace only and resultantly a good steel sheet cannot be produced stably.

In the meantime, a hot-rolled steel sheet and a cold-rolled steel sheet obtained by utilizing the transformation-induced plasticity of retained austenite contained in the steel are developed. Those are the steel sheets, each of which contains retained austenite in the metallographic structure through heat treatment, that is characterized by: containing only about 0.07 to 0.4% C, about 0.3 to 2.0% Si and about 0.2 to 2.5% Mn as basic alloying elements without containing expensive alloying elements; and applying bainite transformation in the temperature range nearly from 300° C. to 450° C. after annealing in a dual phase zone. For example, Japanese Unexamined Patent Publication Nos. H1-230715 and H2-217425 disclose such steel sheets. As such steel sheets, not only a cold-rolled steel sheet is produced through continuous annealing but also it is disclosed that a hot-rolled steel sheet can also be obtained by controlling the cooling on run-out tables and a coiling temperature in Japanese Unexamined Patent Publication No. H1-79345, for example.

The trend of applying plating to automobile members is growing with the aim of improving corrosion resistance and appearance in conformity with the trend of a higher-grade automobile and galvanized steel sheets are presently used for a variety of members excluding specific members mounted in the interior of an automobile. Therefore, it is effective from the viewpoint of corrosion resistance to use a steel sheet subjected to hot-dip galvanizing or alloying hot-dip galvanizing wherein alloying treatment is applied after hot-dip galvanizing as such a steel sheet. However, in the case of a steel sheet having high Si and Al contents among such high-strength steel sheets, there is the problem in that an oxide film tends to form on the surface of the steel sheet, therefore fine non-plated portions are generated at the time of hot-dip galvanizing, and resultantly the plating performance deteriorates at the portions processed after alloying. Therefore, it is the present situation that a high-strength high-ductility alloyed hot-dip galvanized steel sheet of high Si and Al type, the steel sheet being excellent in corrosion resistance and plating performance at processed portions, is not practically applied.

In the case of a steel sheet disclosed in Japanese Unexamined Patent Publication Nos. H1-230715 and H2-217425 for example, since Si is added by 0.3 to 2.0% and retained austenite is secured by utilizing the unique bainite transformation, an intended metallographic structure cannot be obtained and the strength and elongation deviate from the target ranges unless the cooling after annealing in the dual phase coexisting temperature range and the retention of the steel sheet in the temperature range nearly from 300° C. to 450° C. are extremely strictly controlled. Such a heat history can be realized industrially in continuous annealing equipment, run-out tables after hot rolling and a coiling process. In this case, when the temperature range is from 450° C. to 600° C., since the transformation of austenite is completed soon, such control as to particularly shorten the time duration where a steel sheet is retained in the temperature range from 450° C. to 600° C. is required. Even when the temperature range is from 350° C. to 450° C., since the metallographic structure varies considerably in accordance with the retention time, only poor strength and elongation are obtained in the case of deviating from prescribed conditions. Further, the problem here is that, since the retention time in the temperature range from 450° C. to 600° C. is long and Si that deteriorates plating performance is contained as an alloying element, it is impossible to produce a plated steel sheet through hot-dip plating equipment, the surface corrosion resistance is inferior, and thus a wide range of industrial application is hindered.

In order to solve the aforementioned problems, for example, Japanese Unexamined Patent Publication Nos. H5-247586 and H6-145788 disclose a steel sheet having the plating performance which is improved by regulating an Si concentration. In this method, retained austenite is formed by adding Al instead of Si. However, the problem of the method is that, since Al, like Si, is also more likely to be oxidized than Fe, Al and Si tend to incrassate and form an oxide film on the surface of a steel sheet and sufficient plating performance is not obtained. Further, Japanese Unexamined Patent Publication No. H5-70886 discloses the technology wherein plating wettability is improved by adding Ni. However, the method does not disclose the relationship between Ni and the group of Si and Al that deteriorate plating wettability.

Furthermore, for example, Japanese Unexamined Patent Publication Nos. H4-333552 and H4-346644 disclose the method wherein a steel sheet is subjected to rapid low temperature heating after Ni preplating, hot-dip galvanizing and successively alloying treatment as an alloying hot-dip plating method of a high Si type high-strength steel sheet. However, the problem of the method is that new equipment is required because Ni preplating is essential. Further, this method neither makes retained austenite remain in the final structure nor refers to a means to do so.

Yet further, for example, Japanese Unexamined Patent Publication No. 2002-234129 discloses the method wherein good properties are obtained by adding Cu, Ni and Mo to a steel sheet containing Si and Al. It says that, in the method, good plating performance and material properties can be obtained by properly adjusting the balance between the total amount of Si and Mn and the total amount of Cu, Ni and Mo. However, according to our investigation, a problem of the method is that the patent can not always secure good plating performance when Si is contained since the plating performance of a steel containing Si and Mn is dominated by the amount of Al. Further, another problem thereof is that the method is only applicable to a steel sheet having such relatively low strength as in the range from 440 to 640 MPa in tensile strength.

Moreover, the present inventors propose in PCT Patent Publication WO 00/50658 the technology wherein an appropriate amount of Ni is added to a steel containing Si and Al. However, the problem of the technology is that the quality of a material obtained by this method varies due to the dispersion of an alloying temperature in an attempt to produce an alloyed hot-dip galvanized steel sheet.

SUMMARY OF THE INVENTION

The present invention has been established focusing on the problems of prior arts and the object thereof is to stably provide a hot-dip galvanized steel sheet having a high tensile strength and no non-plated portions and being excellent in workability and surface appearance even when the employed equipment has only a reduction annealing furnace and a steel sheet containing relatively large amounts of Si, Mn and Al that are regarded as likely to cause non-plated portions is used as the substrate steel sheet.

Further, another object of the present invention is to provide a hot-dip galvanized steel sheet: having the composition and the metallographic structure of a high-strength steel sheet excellent in press formability; being capable of securing up to a high strength in the range about from 590 to 1,080 MPa in tensile strength; and being produced through hot-dip plating equipment for the improvement of surface corrosion resistance.

The gist of the present invention is as follows:

(1) A high-strength hot-dip galvanized steel sheet characterized by:

containing, in weight,

C: 0.03 to 0.25%,
Si: 0.05 to 2.0%,
Mn: 0.5 to 2.5%,
P: 0.03% or less,
S: 0.02% or less, and
Al: 0.01 to 2.0%, with the relationship among Si, Mn and Al satisfying the following expression, $$Si+Al+Mn \geqq 1.0\%;$$

a hot-dip plating layer being formed on each of the surfaces of said steel sheet; and 5 to 80% of the surface area of said steel sheet being occupied by oxides when said steel sheet surface is observed with a scanning electron microscope after a hot-dip plating layer is dissolved by fuming nitric acid.

(2) A high-strength hot-dip galvanized steel sheet according to the item (1), characterized by further containing, in weight, one or both of Ni: 0.01 to 2.0% and
Cr: 0.01 to 0.5%.

(3) A high-strength hot-dip galvanized steel sheet according to the item (1) or (2), characterized by the oxides on said steel sheet surface containing one or more of Si, Mn and Al.

(4) A high-strength hot-dip galvanized steel sheet according to the item (2), characterized by further containing, in weight, one or more of Mo: 0.01 to 0.5%,
Cu: 0.01 to 1.0%,
Sn: 0.01 to 0.10%,
V: less than 0.3%,
Ti: less than 0.06%,
Nb: less than 0.06%,
B: less than 0.01%,
REM: less than 0.05%,
Ca: less than 0.05%,
Zr: less than 0.05%, and
Mg: less than 0.05%.

(5) A high-strength hot-dip galvanized steel sheet characterized by, when said steel sheet contains retained austenite and only Mo is added among the elements stipulated in the item (4):

the relationship among Si, Al and Ni satisfying the following expressions, $$0.4(\%) \leqq Si(\%)+Al(\%) \leqq 2.0(\%),$$

$$Ni(\%) \geqq \tfrac{1}{5} \times Si(\%)+\tfrac{1}{10} \times Al(\%), \text{ and}$$

$$\tfrac{1}{20} \times Ni(\%) \leqq Mo(\%) \leqq 10 \times Ni(\%); \text{ and}$$

the volume ratio of said retained austenite in said steel sheet being in the range from 2 to 20%.

(6) A high-strength hot-dip galvanized steel sheet characterized by, when said steel sheet contains retained austenite and Cu or Sn is further added in addition to Mo among the elements stipulated in the item (4):

the relationship among Ni, Cu and Sn satisfying the following expression, $$2 \times Ni(\%) > Cu(\%)+3 \times Sn(\%);$$

the relationship among Si, Al, Ni, Cu and Sn satisfying the following expression, $$Ni(\%)+Cu(\%)+3 \times Sn(\%) \geqq \tfrac{1}{5} \times Si(\%)+\tfrac{1}{10} \times Al(\%); \text{ and}$$

the volume ratio of said retained austenite in said steel sheet being in the range from 2 to 20%.

(7) A method for producing a high-strength hot-dip galvanized steel sheet characterized in that the volume ratio of retained austenite in said steel sheet is in the range from 2 to 20% and a hot-dip galvanizing layer is formed on each of the surfaces of said steel sheet by subjecting a steel sheet satisfying the component ranges stipulated in the item (5) or (6) to the processes of: annealing the hot-rolled and cold-rolled steel sheet for 10 sec. to 6 min. in the dual phase coexisting temperature range of 750° C. to 900° C.; subsequently cooling up to 350° C. to 500° C. at a cooling rate of 2 to 200° C./sec., or occasionally heat retention for 10 min. or less in said temperature range; subsequently hot-dip galvanizing; and thereafter cooling to 250° C. or lower at a cooling rate of 5° C./sec. or more.

(8) A method for producing a high-strength hot-dip galvanized steel sheet characterized in that the volume ratio of retained austenite in said steel sheet is in the range from 2 to 20% and an alloyed hot-dip galvanizing layer containing 8 to 15% Fe is formed on each of the surfaces of said steel sheet by subjecting a steel sheet satisfying the component ranges stipulated in the item (5) or (6) to the processes of: annealing the hot-rolled and cold-rolled steel sheet for 10 sec. to 6 min. in the dual phase coexisting temperature range of 750° C. to 900° C.; subsequently cooling up to 350° C. to 500° C. at a cooling rate of 2 to 200° C./sec., or occasionally heat retention for 10 min. or less in said temperature range; thereafter hot-dip galvanizing; subsequently heat retention for 5 sec. to 2 min. in the temperature range from 450° C. to 600° C.; and thereafter cooling to 250° C. or lower at a cooling rate of 5° C./sec. or more.

(9) A method for producing a high-strength hot-dip galvanized steel sheet characterized by subjecting a steel sheet satisfying the component ranges stipulated in the item (1) or (2), before subjecting said steel sheet to hot-dip galvanizing, to treatment in an atmosphere controlled so that: said atmosphere may have an oxygen concentration of 50 ppm or less in the temperature range from 400° C. to 750° C.; and, when a hydrogen concentration, a dew point and an oxygen concentration in said atmosphere are defined by H (%), D (° C.) and O (ppm) respectively, H, D and O may satisfy the following expressions for 30 sec. or longer in the temperature range of 750° C. or higher, $$O \leqq 30 \text{ ppm, and}$$

$$20 \times \exp(0.1 \times D) \leqq H \leqq 2{,}000 \times \exp(0.1 \times D).$$

(10) A method for producing a high-strength hot-dip galvanized steel sheet characterized by subjecting a steel sheet satisfying the component ranges stipulated in the item (2), before subjecting said steel sheet to hot-dip galvanizing, to treatment in an atmosphere controlled so that, when a hydrogen concentration and a dew point in said atmosphere and an Ni concentration in said steel sheet are defined by H (%), D (° C.) and Ni (%) respectively, H, D and Ni may satisfy the following expression for 30 sec. or longer in the temperature range of 750° C. or higher, $$3 \times \exp\{0.1 \times (D+20 \times (1-Ni(\%)))\} \leqq H \leqq 2{,}000 \times \exp\{0.1 \times (D+20 \times (1-Ni(\%)))\}.$$

(11) A high-strength hot-dip galvanized steel sheet according to the item (1) or (2), characterized in that the hot-dip galvanizing layer being formed on each of the surface of said steel sheet, characterized in that, when a section of said steel sheet is observed with SEM, wherein the surface of the steel sheet immediately under said hot-dip galvanizing layer is oxidized.

(12) A high-strength hot-dip galvanized steel sheet according to the item (1) or (2), characterized in that said steel sheet is further heated and alloyed.

(13) A high-strength hot-dip galvanized steel sheet according to item (1), a hot-dip galvanizing layer being formed on each of the surfaces of said steel sheet, characterized in that, when a section of said steel sheet is observed with an SEM, the maximum length of oxides observed in the surface layer of the base material immediately under said hot-dip galvanizing layer is 3 μm or less and said oxides have gaps between them.

THE MOST PREFERRED EMBODIMENT

Figure 1:
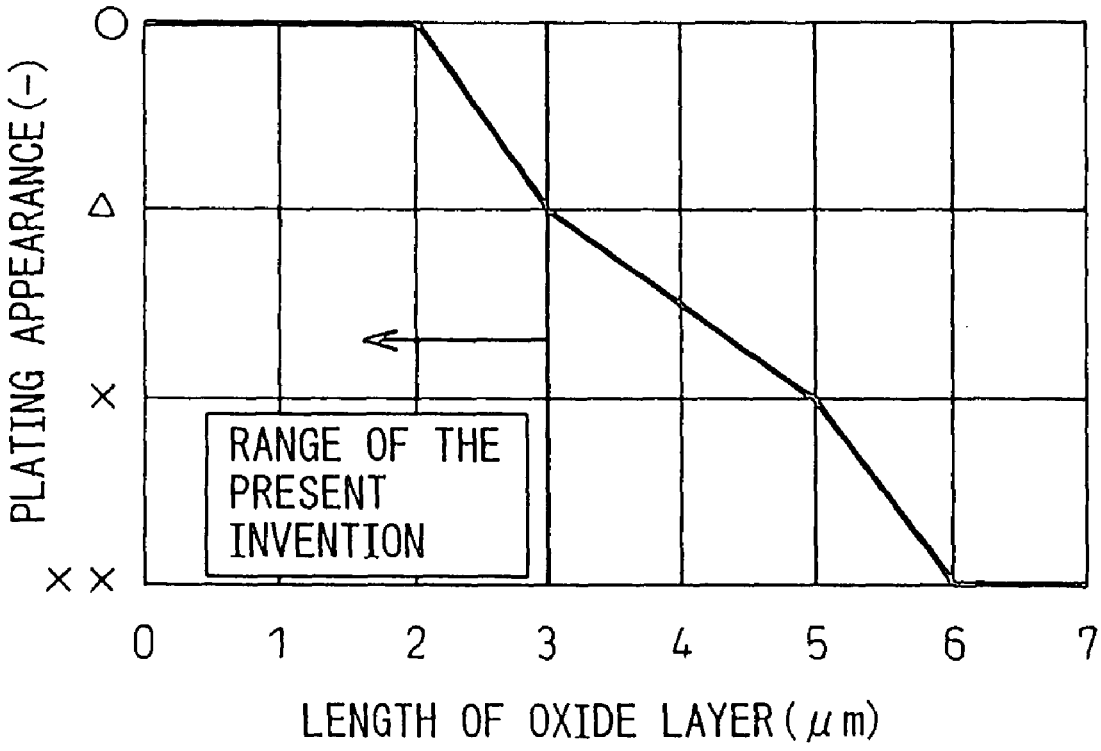
FIG. 1 is a graph showing the relationship between the plating appearance and the size of oxides in the surface layer of a hot-dip galvanized steel sheet according to the present invention.

The object of regulating components in the present invention is to provide a high-strength hot-dip galvanized steel sheet excellent in press formability and the reasons therefor are hereunder explained in detail.

C is an element that stabilizes austenite, moves from the inside of ferrite and incrassates in austenite in the dual phase coexisting temperature range and the bainite transformation temperature range. As a result, chemically stabilized austenite of 2 to 20% remains even after cooled to the room temperature and improves formability due to transformation-induced plasticity. When a C concentration is less than 0.03%, retained austenite of 2% or more is hardly secured and the object of the present invention is not attained. On the other hand, a C concentration exceeding 0.25% deteriorates weldability and therefore must be avoided.

Si does not dissolve in cementite and, by suppressing the precipitation thereof, delays the transformation from austenite in the temperature range from 350° C. to 600° C. Since C incrassation into austenite is accelerated during the process, the chemical stability of austenite increases, transformation-induced plasticity is caused, and resultantly retained austenite that contributes to the improvement of formability can be secured. When an Si amount is less than 0.05%, the effects do not show up. On the other hand, when an Si concentration is raised, plating performance deteriorates. Therefore, an Si concentration must be 2.0% or less.

Mn is an element that forms austenite and makes retained austenite remain in a metallographic structure after cooled up to the room temperature since Mn prevents austenite from being decomposed into pearlite during the cooling to 350° C. to 600° C. after the annealing in the dual phase coexisting temperature range. When an addition amount of Mn is less than 0.5%, a cooling rate has to be so increased as to make industrial control impossible in order to suppress the decomposition into pearlite and therefore it is inappropriate. On the other hand, when an Mn amount exceeds 2.5%, a band structure becomes conspicuous, properties are deteriorated, a spot weld tends to break in a nugget, and therefore it is undesirable.

Al is used as a deoxidizer, at the same time, does not dissolve in cementite like Si, suppresses the precipitation of cementite during retention in the temperature range from 350° C. to 600° C., and delays the progress of transformation. However, since the capability of Al in the formation of ferrite is stronger than Si, by the addition of Al, transformation starts early, C is incrassated in austenite from the time of annealing in the dual phase coexisting temperature range even for a short time of retention, chemical stability is increased, and therefore martensite that deteriorates formability scarcely exists in a metallographic structure after cooled up to the room temperature. For that reason, when Al coexists with Si, the variation of strength and elongation caused by retention conditions in the temperature rang from 350° C. to 600° C. reduces and it becomes easy to obtain high strength and good press formability. In order to secure the above effects, it is necessary to add Al by 0.01% or more. In addition, Al, together with Si, must be controlled so that Si+Al may be 0.4% or more. On the other hand, when an Al concentration exceeds 2.0%, Al deteriorates plating performance like Si does and therefore the case should be avoided. Further, for securing plating performance, Al, together with Si and Mn, must be controlled so that Si+Al+Mn may be 1.0% or more.

In the present invention, good plating performance is secured by intentionally forming oxides on a steel sheet surface and resultantly suppressing the incrassation of Si, Mn and Al in the surface layer at portions where oxides are not formed. In this light, the area ratio of oxides formed in a steel sheet surface layer is important in the present invention. The reason why the area ratio of oxides on a steel sheet surface is regulated to 5% or more in the present invention is that, with an area ratio of 5% or less, the concentrations of Si, Al and Mn on a steel sheet surface are high even in the region where oxides are not formed and therefore good plating performance is not secured due to the incrassated Si, Al and Mn. In other words, the incrassated Si, Al and Mn hinder hot-dip galvanizing. In order to secure better plating performance, it is preferable that an area ratio is 15% or more. Further, the upper limit is set at 80%. The reason is that, in the state where oxides are formed in excess of 80%, the area ratio of portions where oxides are not formed is less than 20% and therefore good plating performance is hardly secured only with those portions. In order to secure better plating performance, it is preferable that an area ratio is 70% or less. Here, in the present invention, an area ratio of oxides is determined by observing a steel sheet surface in the visual field of 1 mm×1 mm with a scanning electron microscope (SEM) after dissolving a hot-dip galvanizing layer by fuming nitric acid.

Ni is an element that is important to the present invention and produces austenite similarly to Mn, and at the same time improves strength and plating performance. Further, Ni, like Si and Al, does not dissolve in cementite, suppresses the precipitation of cementite during retention in the temperature range from 350° C. to 600° C., and delays the progress of transformation. When a plated steel sheet is produced using a steel sheet containing Si and Al in a continuous hot-dip galvanizing line, Si and Al, since they are oxidized more easily than Fe, incrassate on a steel sheet surface, form Si and Al oxides, and deteriorate plating performance. In this light, the present inventors intended to prevent the deterioration of plating performance by incrassating Ni that was more hardly oxidized than Fe on a surface and resultantly changing the shapes of the oxides of Si and Al. As a result of the experimental investigation by the present inventors, it has been found out that good plating performance can be obtained by controlling the relationship among Ni, Si and Al so as to satisfy the expression Ni (%)≧⅕×Si (%)+⅒×Al (%). When an addition amount of Ni is less than 0.01%, sufficient plating performance cannot be obtained in the case of a steel according to the present invention. In contrast, when an Ni concentration is raised in excess of 2.0%, the amount of retained austenite exceeds 20%, elongation deteriorates, at the same time a cost increases, and therefore the results deviate from the ranges stipulated in the present invention. Further preferably, by controlling an Ni concentration to 0.03% or more and so as to satisfy the expression Ni (%)≧⅕×Si (%)+⅒×Al (%)+0.03(%), better plating performance can be obtained.

Next, the investigation is carried out for the purpose of clarifying the oxides existing at the cross-sectional area the difference between a good appearance portion and a bad appearance portion regarding hot-dip galvanizing plating performance of 0.08% C-0.6% Si-2.0% Mn steel, in addition to the oxides existing at the surface area.

As the investigation method, with regard to a good appearance portion without a non-plated portion (○), a portion where a fine non-plated portion 1 mm or smaller in size was formed (Δ), a portion where a non-plated portion larger than 1 mm in size was formed (X) and a portion which was not plated at all (XX), the sections of a plated steel sheet were observed with an SEM and the relationship between the appearance and the average length of a surface oxide layer was investigated. The results are shown in FIG. 1. Whereas no non-plated portions were observed in the case where the length of a surface oxide was 2 μm or less and relatively good plating was formed even in the case of 3 μm, a non-plated portion was observed at a portion where the length of a surface oxide exceeded 3 μm and moreover alloying did not advance at the portion.

Figure 2:
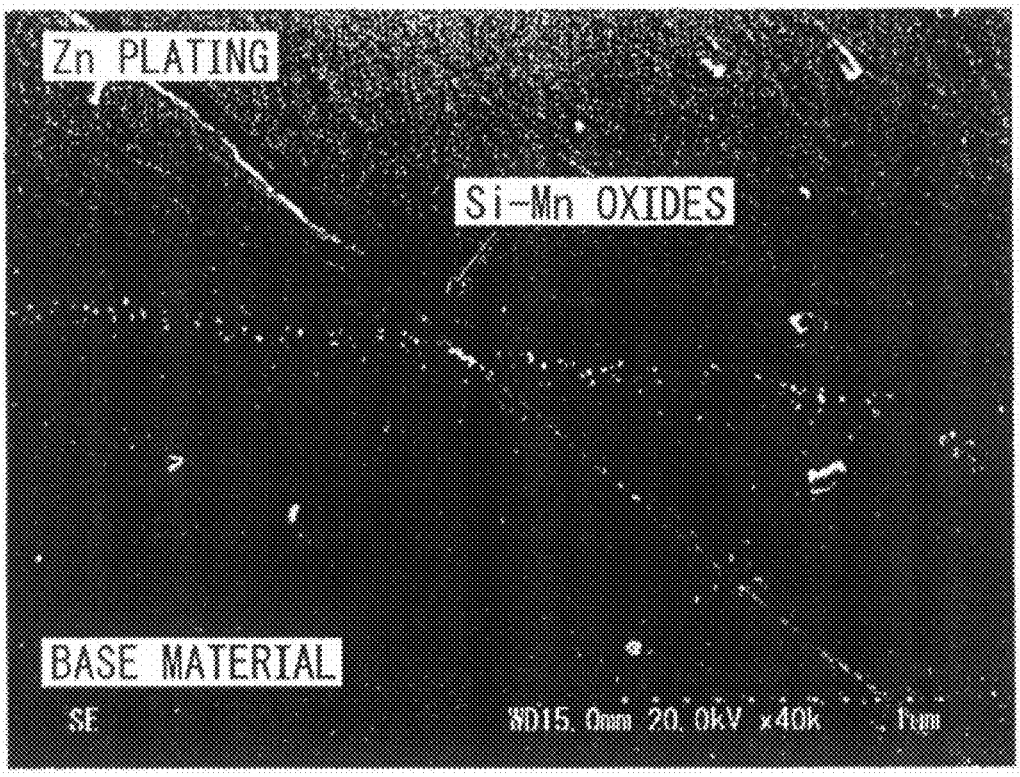
FIG. 2 is a microphotograph showing an example of a section of an alloyed hot-dip galvanized steel sheet having a good plating appearance.

From the above results, it is necessary to control the maximum length of a surface oxide layer to 3 μm or less. Further, in order to obtain better plating appearance, it is desirable to control the maximum length of a surface oxide layer to 2 μm or less. Furthermore, in order to obtain good plating adhesiveness together with good plating appearance, it is desirable to control the maximum length of a surface oxide layer to 1 μm or less. Here, the length of an oxide is determined by observing a section, without applying etching, of a plated steel sheet under a magnification of 40,000 with an SEM and the length of a portion where a gap between oxides exists continuously is regarded as the length of the oxide. A photograph of a section of the portion where good plating performance is secured in an aforementioned plated steel sheet is shown in FIG. 2 as an example. It is understood from the figure that oxides 1 μm or less in length are formed in an off-and-on way. As a result of analyzing the components of the oxides with an EDX, Si, Mn and O were observed and therefore it was confirmed that Si and Mn type oxides were formed on the surface.

The aforementioned effects are accelerated by containing either Ni or Cr in steel.

The present inventors discovered after careful investigation regarding the surface structure of the steel sheet for improving plating that a hot-dip galvanizing ability remarkably improves to obtain a state of an inner oxidization at the surface of the steel sheet immediately under the hot-dip galvanizing layer. This means that the inner oxides are intentionally formed at the steel sheet surface to secure a sufficient plating at the non-forming oxide portions for reducing concentration of Si, Mn and Al which prevent plating ability.

Mo, like Ni, is an element important in the present invention. An alloyed hot-dip galvanized steel sheet according to the present invention is produced by retaining it in the temperature range from 450° C. to 600° C. after hot-dip galvanizing as described later. When a steel sheet is retained in such a temperature range, austenite retained until then is decomposed and carbide is precipitated. By adding Mo, it becomes possible to suppress transformation from austenite and secure the final austenite amount. As a result of studying a means for increasing such effect of Mo, the present inventors found out that the effect showed up conspicuously when only Mo was contained and that it became possible to secure retained austenite when the relationship among Si, Al and Ni satisfied the following expressions, $$0.4(\%) \leqq Si(\%)+Al(\%) \leqq 2.0(\%),$$

$$Ni(\%) \geqq \tfrac{1}{5} \times Si(\%)+\tfrac{1}{10} \times Al(\%), \text{ and}$$

$$\tfrac{1}{20} \times Ni(\%) \leqq Mo(\%) \leqq 10 \times Ni(\%).$$

An addition amount of Mo is preferably more than 0.01% for exhibiting a sufficient plating performance. On the other hand, when an Mo concentration is raised in excess of 0.5%, Mo produces precipitates with C and resultantly it becomes impossible to secure retained austenite. A preferable Mo concentration range is from 0.05 to 0.35%.

P is an element inevitably included in a steel as an impurity. Similarly to Si, Al and Ni, P does not dissolve in cementite and, during the retention in the temperature range from 350° C. to 600° C., suppresses the precipitation of cementite and delays the progress of transformation. However, when a P concentration increases in excess of 0.03%, undesirably, the deterioration of the ductility of a steel sheet becomes conspicuous and at the same time a spot weld tends to break in a nugget. For those reasons, a P concentration is set at 0.03% or less in the present invention.

S is also an element inevitably included in a steel like P. When an S concentration increases, the precipitation of MnS occurs and, as a result, undesirably ductility deteriorates and at the same time a spot weld tends to break in a nugget. For those reasons, an S concentration is set at 0.02% or less in the present invention.

Further, an addition of Cu and Sn that, like Ni, are more hardly oxidized than Fe in appropriate amounts improves plating performance like Ni. By controlling the relationship among Ni, Cu and Sn so as to satisfy the expression 2×Ni (%)>Cu (%)+3×Sn (%), the effect of Cu and Sn on the improvement of plating performance shows up. In this case, by controlling the relationship among Si, Al, Ni, Cu and Sn so as to satisfy the expression Ni (%)+Cu (%)+3×Sn (%)≧⅕×Si (%)+⅒×Al (%), good plating performance can be obtained. The effect shows up conspicuously when Cu is 1.0% or less and Sn is 0.10% or less. When the addition amounts of Cu and Sn exceed the above values, the effect is saturated. In order to elicit the effect of Cu and Sn on the improvement of plating performance more effectively, it is desirable to add either one or both of 0.01 to 1.0% Cu and 0.01 to 0.10% Sn and control components so as to satisfy the expression Ni (%)+Cu (%)+3×Sn (%)≧⅕×Si (%)+1/10×Al (%)+0.03(%).

Cr, V, Ti, Nb and B are elements that enhance strength and REM, Ca, Zr and Mg are elements that combine with S in a steel, reduce inclusions, and resultantly secure a good elongation. An addition of one or more of 0.01 to 0.5% Cr, less than 0.3% V, less than 0.06% Ti, less than 0.06% Nb, less than 0.01% B, less than 0.05% REM, less than 0.05% Ca, less than 0.05% Zr and less than 0.05% Mg as occasion demands does not impair the tenor of the present invention. The effects of those elements are saturated with their respective upper limits and an addition of them in excess of the upper limits only causes cost increase.

A steel sheet according to the present invention contains the aforementioned elements as the fundamental components. However, the steel sheet also contains elements inevitably included in an ordinary steel sheet in addition to the aforementioned elements and Fe, and the tenor of the present invention is not impaired at all even when those inevitably included elements are contained by 0.2% or less in total.

The ductility of a steel sheet according to the present invention as a final product is influenced by the volume ratio of retained austenite contained in the product. Though retained austenite contained in a metallographic structure exists stably when it does not undergo deformation, when deformation is imposed, it transforms into martensite, transformation-induced plasticity appears, and therefore a good formability as well as a high strength is obtained. When a volume ratio of retained austenite is less than 2%, a conspicuous effect is not obtained. On the other hand, when a volume ratio of retained austenite exceeds 20%, in the case of the application of extremely severe forming, a great amount of martensite may possibly exist after press forming and secondary workability and impact resistance may adversely be affected sometimes. For those reasons, the volume ratio of retained austenite is set at 20% or less in the present invention. The structure contains also ferrite, bainite, martensite and carbide.

Though hot-dip galvanizing is adopted in the description of the present invention, it is not limited to the hot-dip galvanizing, and hot-dip aluminum plating, 5% aluminum-zinc plating that is hot-dip aluminum-zinc plating, or hot-dip plating such as so-called Galvalium plating may be adopted. The reason is that the deterioration of plating performance caused by oxides of Si, Al etc. is suppressed by applying the method according to the present invention, resultantly the wettability with not only zinc but also other molten metals such as aluminum is improved, and therefore the forming of non-plated portions is suppressed likewise. Meanwhile, an alloyed hot-dip galvanizing layer contains 8 to 15% Fe and the balance consisting of zinc and unavoidable impurities. The reason why an Fe content in a plating layer is regulated to 8% or more is that chemical treatment (phosphate treatment) performance and film adhesiveness are deteriorated with an Fe content of less than 8%. On the other hand, the reason why an Fe content is regulated to 15% or less is that over-alloying occurs and the plating performance at a processed portion is deteriorated with an Fe content of more than 15%.

In the meantime, the thickness of an alloyed galvanizing layer is not particularly regulated in the present invention. However, a preferable thickness is 0.1 μm or more from the viewpoint of corrosion resistance and 15 μm or less from the viewpoint of workability.

Next, methods for producing a hot-dip galvanized steel sheet and an alloyed hot-dip galvanized steel sheet according to the present invention are explained hereunder.

In continuous annealing of a cold-rolled steel sheet after cold rolling according to a production process of a high-strength hot-dip galvanized steel sheet, the steel sheet is firstly heated in the temperature range from the Ac1 transformation point to Ac3 transformation point in order to form a dual phase structure composed of ferrite and austenite. When a heating temperature is lower than 650° C. at the time, it takes too much time to dissolve cementite again, the amount of existing austenite also decreases, and therefore the lower limit of a heating temperature is set at 750° C. On the other hand, when a heating temperature is too high, the volume ratio of austenite grows too large, a C concentration in austenite lowers, and therefore the upper limit of a heating temperature is set at 900° C. When a soaking time is too short, undissolved carbide is likely to exist and the amount of existing austenite decreases. On the other hand, when a soaking time is too long, crystal grains are likely to coarsen and the balance between strength and ductility deteriorates. For those reasons, the retention time is determined to be in the range from 10 sec. to 6 min.

After the soaking, a steel sheet is cooled to 350° C. to 500° C. at a cooling rate of 2 to 200° C./sec. The object is to carry over austenite formed by heating up to the dual phase zone to the bainite transformation range without transforming it into pearlite and to obtain prescribed properties as retained austenite and bainite at the room temperature by the subsequent treatment. When a cooling rate is less than 2° C./sec. at the time, most part of austenite transforms into pearlite during cooling and therefore retained austenite is not secured. On the other hand, when a cooling rate exceeds 200° C./sec., the deviation of cooling end temperatures between width direction and longitudinal direction increases and a uniform steel sheet cannot be produced.

Thereafter, the steel sheet may be retained for 10 min. or less in the temperature range from 350° C. to 500° C. in some cases. By applying such temperature retention before galvanizing, it is possible to advance bainite transformation, stabilize retained austenite wherein C concentrates, and produce a steel sheet having good balance between strength and elongation more stably. When a cooling end temperature from the dual phase zone exceeds 500° C., in the case of applying subsequent temperature retention, austenite is decomposed into carbide and austenite cannot remain. On the other hand, when a cooling end temperature is lower than 350° C., not only press formability deteriorates though strength increases since most part of austenite transforms into martensite, but also a heat efficiency lowers since a steel sheet temperature must be raised at the time of galvanizing and heat energy must be added. When a retention time exceeds 10 min., both strength and press formability deteriorate since carbide precipitates and non-transformed austenite disappears at the heating after galvanizing. Therefore, a retention time is set at 10 min. or less.

In annealing before applying hot-dip galvanizing in the present invention, it is desirable to control an atmosphere so that: the atmosphere may have an oxygen concentration of 50 ppm or less in the temperature range from 400° C. to 750° C.; and, when a hydrogen concentration, a dew point and an oxygen concentration in the atmosphere are defined by H (%), D (° C.) and 0 (ppm) respectively, H, D and O may satisfy the following expressions for 30 sec. or longer in the temperature range of 750° C. or higher, $$O \leqq 30 \text{ ppm, and}$$

$$20 \times \exp(0.1 \times D) \leqq H \leqq 2{,}000 \times \exp(0.1 \times D).$$

The reason is that a temperature, a time and an atmosphere influence the formation of oxides on a steel sheet surface before plating. In particular, to form such oxides as intended in the present invention, an oxygen concentration on the way of heating in the temperature range from 400° C. to 750° C. is important. Oxides grow with the nuclei of the oxides formed on the way of heating functioning as the origins. In that case, when an oxygen concentration increases, nucleus formation is accelerated, resultantly the length of the oxides observed at a section increases, and a length of 3 μm or less as intended in the present invention is hardly obtained.

In this case, an oxygen concentration is not particularly regulated in the temperature range of lower than 400° C. because oxides are scarcely formed in this temperature range. However, a desirable oxygen concentration is 100 ppm or less. Further, atmospheric conditions other than an oxygen concentration on the way of heating are not particularly regulated. However, a desirable hydrogen concentration is 1% or more and a desirable dew point is 0° C. or lower. Further, by lowering an oxygen concentration to 30 ppm or lower, plating performance improves further. Furthermore, the regulation of the annealing for 30 sec. or longer in the temperature range of 750° C. or higher is determined from the viewpoint of not plating performance but recrystallization related to the properties of a base material. In an atmosphere in this temperature range, when oxygen and hydrogen concentrations decrease and a dew point increases, oxides form on a steel sheet surface.

Figure 3:
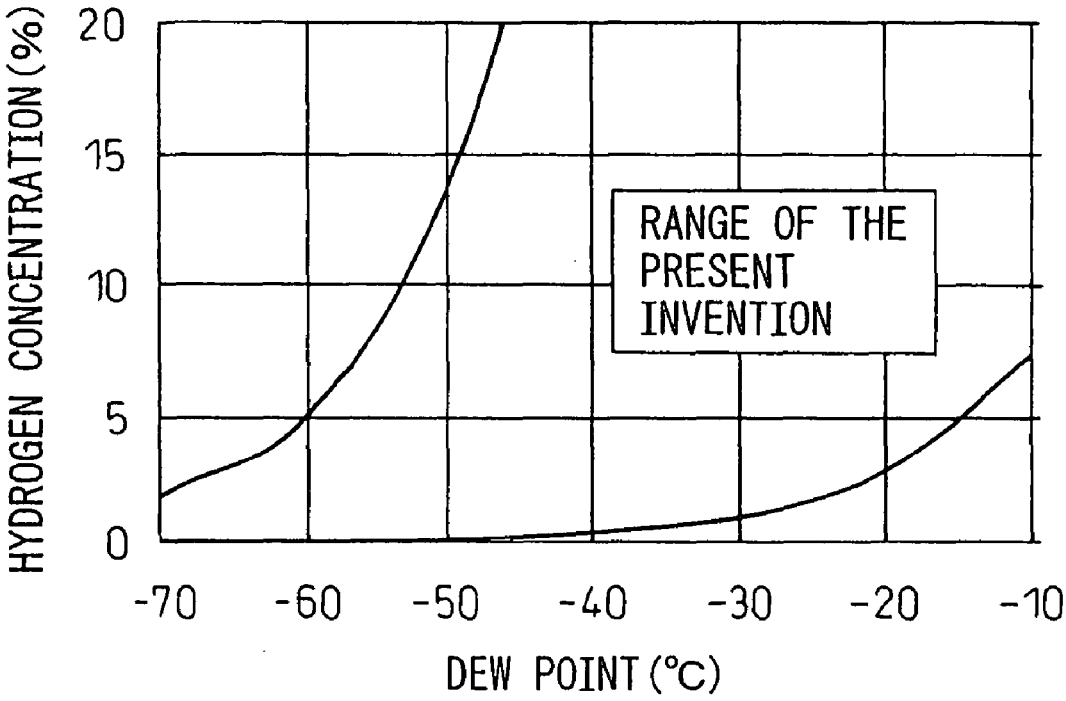
FIG. 3 is a graph showing the relationship between hydrogen and a dew point in an atmosphere desirable for annealing prior to hot-dip galvanizing in the present invention.

As a result of detailed investigations by the present inventors, it has been found that the maximum length of surface oxides can be reduced to 3 μm or less by annealing a steel sheet in an atmosphere satisfying the aforementioned expressions. Here, desirably, by controlling a hydrogen concentration to not more than $1{,}500\times\exp\{0.1\times[D+20\times(1-Ni(\%))]\}$ in relation to a dew point and an oxygen concentration to not more than 20 ppm for 30 sec. or longer in the temperature range of 750° C. or higher, plating performance is more likely to be improved. The above relationship between a hydrogen concentration and a dew point is shown in FIG. 3.

In annealing before applying hot-dip galvanizing in the present invention, it is desirable to control an atmosphere so that, when a hydrogen concentration and a dew point in the atmosphere and an Ni concentration in a steel are defined by H (%), D (° C.) and Ni (%) respectively, H, D and Ni may satisfy the following expression for 30 sec. or longer in the temperature range of 750° C. or higher, $$3\times\exp\{0.1\times(D+20\times(1-Ni(\%)))\}\leqq H\leqq 2{,}000\times\exp\{0.1\times(D+20\times(1-Ni(\%)))\}.$$

The reason is that an Ni content in a steel, a temperature, a time and an atmosphere influence the formation of oxides on a steel sheet surface before plating. By raising a temperature and increasing a time at a high temperature, the formation of oxides is accelerated and oxides are formed on a steel sheet surface. Further, when a hydrogen concentration lowers and a dew point rises in an atmosphere, internal oxidization is accelerated. Further, as stated above, by containing Ni in a steel, internal oxidization can be advanced easily. As a result of detailed investigations by the present inventors, it has been found that internal oxidization can be advanced by applying annealing in such an atmosphere as to satisfy the aforementioned relationship. Here, desirably, by controlling a hydrogen concentration to not more than $800\times\exp\{0.1\times(D+20\times(1-Ni(\%)))\}$, internal oxidization is more likely to be obtained.

When Ni is added to the steel sheet, an oxidization is restrained by oxygen contained in the atmosphere. The oxygen concentration is preferably limited to less than 100 ppm.

When a hot-dip galvanized steel sheet is produced, the steel sheet is cooled to 250° C. or lower at a cooling rate of 5° C./sec. or more after plating. By so doing, a structure containing the mixture of: bainite scarcely containing carbide because of the advancement of bainite transformation during galvanizing; retained austenite wherein C discharged from the bainite incrassates and the Mn point lowers to the room temperature or lower; and ferrite wherein purification is advanced during heating in the dual phase zone is formed, and a good balance between a high strength and formability is obtained. In this light, when a cooling rate after retention is lowered to not more than 5° C./sec. or a cooling end temperature is raised to not lower than 250° C., since austenite wherein C incrassates during cooling also precipitates carbide and is decomposed into bainite, the amount of retained austenite that improves workability by the effect of transformation-induced plasticity decreases, and resultantly the object of the present invention cannot be achieved.

Further, when an alloyed hot-dip galvanized steel sheet is produced, after the hot-dip galvanizing, the steel sheet is retained for 5 sec. to 2 min. in the temperature range from 450° C. to 600° C., and thereafter cooled to 250° C. or lower at a cooling rate of 5° C./sec. or more. Those conditions are determined from the viewpoint of alloying reaction and a structural aspect. In a steel according to the present invention, since the steel contains Si and Al, by utilizing the fact that the transformation from austenite to bainite is separated into two stages, a structure containing the mixture of: bainite scarcely containing carbide; retained austenite wherein C discharged from the bainite incrassates and the Mn point lowers to the room temperature or lower; and ferrite wherein purification is advanced during heating in the dual phase zone is formed, and a good balance between a high strength and formability is obtained. When a retention temperature exceeds 600° C., pearlite is formed, thus retained austenite becomes not contained, further alloying reaction advances too much, and therefore an Fe concentration in a plating layer exceeds 12%. On the other hand, when a retention temperature is 450° C. or lower, an alloying reaction speed of plating decreases and an Fe concentration in the plating layer decreases. Further, when a retention time is 5 sec. or less, since bainite forms insufficiently and C incrassation into not-transformed austenite is also insufficient, martensite forms during cooling, formability deteriorates, and at the same time alloying reaction of plating becomes insufficient. On the other hand, when a retention time is 2 min. or longer, excessive alloying of plating occurs and plating exfoliation and the like are likely to occur at the time of forming. Further, when a cooling rate after retention is lowered to 5° C./sec. or less or a cooling end temperature is raised to 250° C. or higher, since bainite transformation advances further and austenite wherein C is incrassated by the preceding reaction also precipitates carbide and is decomposed into bainite, the amount of retained austenite that improves workability by the effect of transformation-induced plasticity decreases, and resultantly the object of the present invention cannot be achieved.

A desirable hot-dip galvanizing temperature is in the range from the melting point of plating metal to 500° C. The reason is that, when a temperature is 500° C. or higher, vapor from the plating bath becomes abundant and operability deteriorates. Further, it is not particularly necessary to regulate a heating rate up to a retention temperature after plating. However, a desirable heating rate is 3° C./sec. or more from the viewpoint of a plating structure and a metallographic structure.

Note that, temperatures and cooling rates in the aforementioned processes are not necessarily constant as long as they are within the regulated ranges and, even if they vary in the respective ranges, the properties of a final product do not deteriorate at all or rather improve in some cases.

In addition, to improve plating performance further, a steel sheet after cold rolled may be plated with Ni, Cu, Co and Fe individually or complexly before annealing. Further, to improve plating performance, purification of a steel sheet surface may be applied before plating by adjusting an atmosphere at the time of annealing of the steel sheet, oxidizing the steel sheet surface beforehand, and thereafter reducing it. Further, to improve plating performance, oxides on a steel sheet surface may be removed by pickling or grinding the steel sheet before annealing and even in that case there is no problem. Plating performance improves further by adopting those treatments.

EXAMPLE

Example 1

Using a hot-dip plating simulator, various kinds of hot-dip galvanized steel sheets were produced by subjecting various steel sheets shown in Table 1 to the processes of: annealing for 100 sec. at 800° C. at a heating rate of 5° C./sec. in an atmosphere of 8% hydrogen and −30° C. dew point; subsequently dipping in a hot-dip galvanizing bath; and air cooling to the room temperature. Here, a metal composed of zinc containing 0.14% Al was used in a hot-dip galvanizing bath. Further, the dipping time was set at 4 sec. and the dipping temperature was set at 460° C.

The plating performance of the hot-dip galvanized steel sheets thus produced was evaluated visually. The evaluation results were classified by the marks, ○: no non-plated portion and X: having non-plated portions. Further, the adhesiveness of hot-dip galvanizing was evaluated by exfoliation of a specimen with a tape after 0T bending and the evaluation results were classified by the marks, ○: no exfoliation and X: exfoliated. Furthermore, the area ratio of oxides on a steel sheet surface was determined by observing the steel sheet surface in a visual field of 1 mm×1 mm with a scanning electron microscope (SEM) after a plating layer of the plated steel sheet is dissolved by fuming nitric acid. In this measurement, in consideration of the fact that an oxide layer looked black when the oxide layer was observed by the secondary electron image of scanning electron microscopy, the area ratio of the black portion was defined as the area ratio of oxides. The results, together with the components of the steel sheets, are shown in Table 3.

It is understood that, in the examples satisfying the requirements stipulated in the present invention, excellent plating performance is obtained. In contrast, in the examples not satisfying the requirements stipulated in the present invent, the area ratios of oxides are 20% or less and thus excellent plating performance cannot be obtained.

Figure 4:
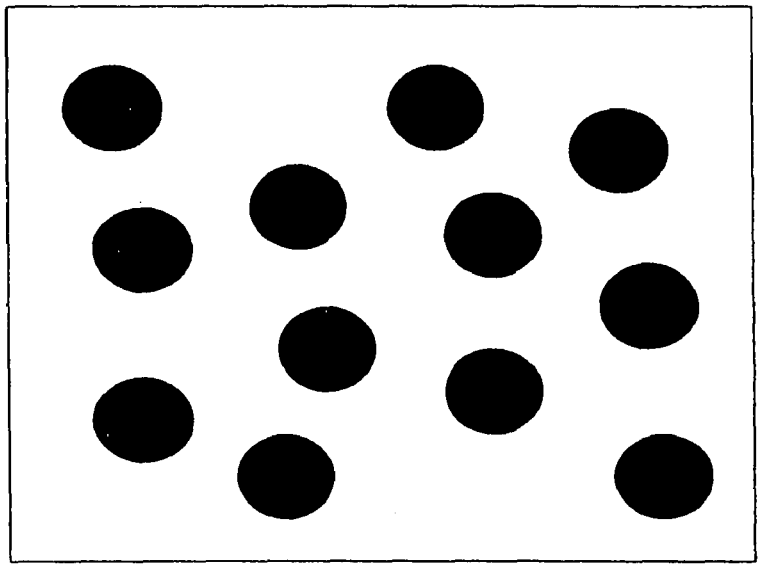
FIG. 4 is a schematic illustration of a scanning electron microphotograph of the surface of the steel sheet produced under the condition 4 in EXAMPLE 4 after a hot-dip galvanizing layer is dissolved by fuming nitric acid.
Figure 5:
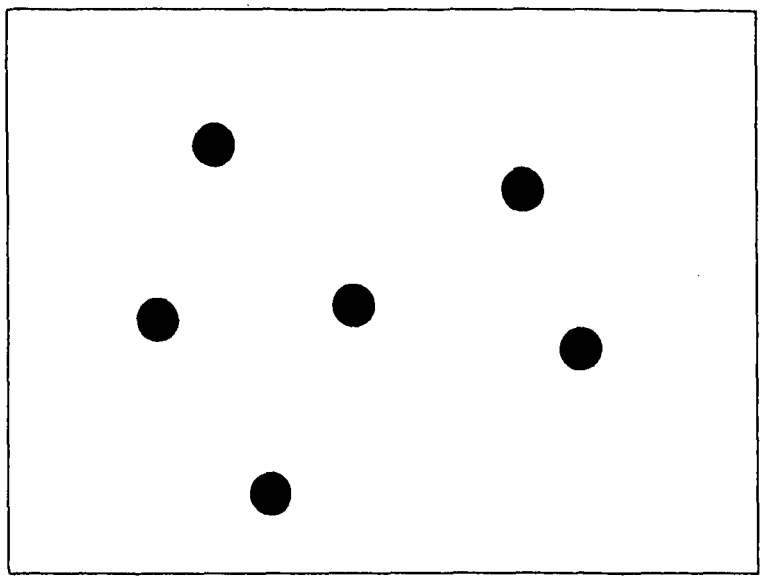
FIG. 5 is a schematic illustration of a scanning electron microphotograph of the surface of the steel sheet produced under the condition 11 (comparative example) in EXAMPLE 4 after a hot-dip galvanizing layer is dissolved by fuming nitric acid.

FIG. 4 is a schematic illustration of an image of the scanning electron microscopy obtained by observing a steel sheet surface after a plating layer thereon is dissolved by fuming nitric acid after the plating of the condition No. 4 that shows good plating performance is applied. In contrast, FIG. 5 is a schematic illustration of an image of the scanning electron microscopy obtained by observing a steel sheet surface after a plating layer thereon is dissolved by fuming nitric acid after the plating of the condition No. 10. In the figures, the black portions represent oxides and the white portions represent ones where oxides are not observed. It is understood that, whereas black oxides are scarcely observed in FIG. 5, black oxides are observed in the surface layer of the steel sheet in FIG. 4. Further, it has been confirmed that the oxides of the condition No. 4 are the ones containing Si and Mn from the analysis of the components by EDX. As a result of measuring an area ratio from an image of an electron microscope, whereas the area ratio of oxides was 40% and good plating performance was obtained in the condition No. 4, the area ratio was 2%, non-plated portions appeared and plating performance was also inferior in the condition No. 10.

TABLE 1

| | Steel sheet components (weight %) | | | | | | Oxide | Plating | Plating | |
|---|---|---|---|---|---|---|---|---|---|---|
| Condition | C | Si | Al | Mn | Ni | Others | area ratio | performance | adhesiveness | Remarks |
| 1 | 0.05 | 0.30 | 0.03 | 1.2 | 0.01 | | 10 | ○ | ○ | Invention example |
| 2 | 0.09 | 1.70 | 0.25 | 1.6 | 0.800 | | 70 | ○ | ○ | Invention example |
| 3 | 0.21 | 0.08 | 1.60 | 1.3 | 0.200 | | 50 | ○ | ○ | Invention example |
| 4 | 0.11 | 0.90 | 0.60 | 1.2 | 0.600 | Cu: 0.3 | 40 | ○ | ○ | Invention example |
| 5 | 0.15 | 0.25 | 1.62 | 1.2 | 0.800 | Mo: 0.1 | 50 | ○ | ○ | Invention example |
| 6 | 0.06 | 0.24 | 1.20 | 2.4 | 0.150 | | 25 | ○ | ○ | Invention example |
| 7 | 0.03 | 0.40 | 0.50 | 0.7 | 0.240 | Sn: 0.05 | 30 | ○ | ○ | Invention example |
| 8 | 0.16 | 2.21 | 0.03 | 1.5 | 0.950 | Mo: 0.3 | 1 | X | X | Comparative example |
| 9 | 0.24 | 0.15 | 2.15 | 0.7 | 0.900 | Cu: 0.7, Sn: 0.05 | 3 | X | X | Comparative example |
| 10 | 0.06 | 0.10 | 0.06 | 2.6 | 0.950 | | 2 | X | X | Comparative example |

Example 2

Steel sheets were produced by subjecting steels having the components shown in Table 2 to hot rolling, cold rolling, annealing, plating and thereafter skin passing at a reduction ratio of 0.6% under the conditions shown in Table 3. The produced steel sheets were subjected to tensile tests, retained austenite measurement tests, welding tests, plating appearance tests and plating performance tests, those being explained below. Further, when alloyed hot-dip galvanized steel sheets were produced, they were subjected to the tests for measuring Fe concentrations in plating layers. Here, the coating weight on a surface was controlled to 40 g/mm$^2$.

With regard to a tensile test, a JIS #5 tensile test specimen was sampled and subjected to a tensile test under the conditions of the gage thickness of 50 mm, the tensile speed of 10 mm/min. and the room temperature.

With regard to a retained austenite measurement test, a plane in the depth of one-fourth the sheet thickness from the surface was chemically polished and thereafter subjected to measurement by the method called five-peak method wherein the strengths of α-Fe and γ-Fe were measured in X-ray diffraction using an Mo bulb.

With regard to a welding test, a test specimen was spot-welded under the conditions of the welding current of 10 kA, the loading pressure of 220 kg, the welding time of 12 cycles, the electrode diameter of 6 mm, the electrode of a dome shape and the tip size of 6ϕ-40R and the test specimen was evaluated by the number of continuous welding spots at the time when the nugget diameter reached 4√t (t: sheet thickness). The results of the evaluation were classified by the marks, ○: over 1,000 continuous welding spots, Δ: 500 to 1,000 continuous welding spots, and X: less than 500 continuous welding spots, and the mark ○ was regarded as acceptable and the marks Δ and X were regarded as unacceptable.

With regard to a plating appearance test, the state of the occurrence of non-plated portions was evaluated visually from the appearance of a plated steel sheet. The results of the evaluation were classified by the marks, ◎: less than 3 non-plated portions/dm$^2$, ○: 4 to 10 non-plated portions/dm$^2$, Δ: 11 to 15 non-plated portions/dm$^2$, and X: 16 or more non-plated portions/dm$^2$, and the marks ◎ and ○ were regarded as acceptable and the marks Δ and X were regarded as unacceptable.

With regard to plating adhesiveness, a plated steel sheet was subjected to a 60-degree V-bending test and then a tape exfoliation test and was evaluated by the degree of blackening of the tape. The results of the evaluation were classified by the marks, ◎: 0 to 10% in blackening degree, ○: 10 to less than 20% in blackening degree, Δ: 20 to less than 30% in blackening degree, and X: 30% or more in blackening degree, and the marks ◎ and ○ were regarded as acceptable and the marks Δ and X were regarded as unacceptable.

With regard to the measurement test of an Fe concentration in a plating layer, a test specimen was measured by the IPC emission spectrometry after the plating layer thereof was dissolved by 5% hydrochloric acid containing an amine system inhibitor.

The results of the above property evaluation tests are shown in Tables 2 to 10. The specimens Nos. 1 to 14 according to the present invention are the hot-dip galvanized steel sheets and the alloyed hot-dip galvanized steel sheets, while the retained austenite ratios thereof are 2 to 20% and the tensile strengths thereof are 590 to 1,080 MPa, having good total elongations, a good balance between high strength and press formability, and at the same time satisfactory plating performance and weldability. In contrast, the specimens Nos. 15 to 29 satisfy none of the retained austenite amount, the compatibility of a high strength and a good press formability, plating performance and weldability and do not attain the object of the present invention, since the C concentration is low in the specimen No. 15, the C concentration is high in the specimen No. 16, the Si concentration is high in the specimen No. 17, the Mn concentration is low in the specimen No. 18, the Mn concentration is high in the specimen No. 19, the Al concentration is high in the specimen No. 20, the relationship between Si and Al in the steel is not satisfied in the specimen No. 21, the P concentration is high in the specimen No. 22, the S concentration is high in the specimen No. 23, the Ni concentration is low in the specimen No. 24, the Ni concentration is high in the specimen No. 25, the Mo concentration is low in the specimen No. 26, the Mo concentration is high in the specimen No. 27, the relational expression between Ni and Mo is not satisfied in the specimen No. 28, and the relationship between the group of Si and Al and the group of Ni, Cu and Sn is not satisfied in the specimen No. 29.

Further, even a steel sheet according to the present invention, if there is any problem in the treatment conditions, satisfies none of the retained austenite amount, the compatibility of a high strength and a good press formability, plating performance and weldability and does not attain the object of the present invention, as seen in the specimens Nos. 30 to 63.

TABLE 2

| | Components (weight %) | | | | | | | | | |
|---|---|---|---|---|---|---|---|---|---|---|
| | C | Si | Mn | Al | P | S | Ni | Cu | Sn | Mo |
| a | 0.13 | 0.61 | 1.13 | 0.58 | 0.009 | 0.002 | 0.51 | 0 | 0 | 0.12 |
| b | 0.10 | 1.15 | 1.20 | 0.10 | 0.010 | 0.002 | 0.63 | 0.15 | 0 | 0.05 |
| c | 0.13 | 1.53 | 1.43 | 0.08 | 0.008 | 0.003 | 0.81 | 0.25 | 0 | 0.06 |
| d | 0.16 | 0.63 | 1.51 | 0.62 | 0.009 | 0.004 | 0.35 | 0.52 | 0 | 0.15 |
| e | 0.16 | 1.45 | 1.65 | 0.12 | 0.011 | 0.003 | 0.82 | 0.25 | 0 | 0.30 |
| f | 0.18 | 0.65 | 1.93 | 0.63 | 0.008 | 0.003 | 0.82 | 0.53 | 0 | 0.25 |
| g | 0.12 | 0.91 | 1.15 | 0.31 | 0.012 | 0.003 | 0.56 | 0.13 | 0.03 | 0.06 |
| h | 0.17 | 0.38 | 1.21 | 1.02 | 0.013 | 0.005 | 0.55 | 0.05 | 0.05 | 0.10 |
| i | 0.15 | 0.82 | 1.35 | 0.45 | 0.011 | 0.006 | 0.63 | 0.34 | 0 | 0.05 |
| j | 0.21 | 0.15 | 1.56 | 1.21 | 0.013 | 0.005 | 1.31 | 0.13 | 0 | 0.15 |
| k | 0.03 | 0.45 | 1.82 | 0.22 | 0.015 | 0.004 | 0.35 | 0.42 | 0.03 | 0.05 |
| l | 0.27 | 0.22 | 1.52 | 1.13 | 0.021 | 0.015 | 0.62 | 0 | 0.06 | 0.15 |
| m | 0.12 | 1.92 | 1.42 | 0.03 | 0.016 | 0.008 | 0.95 | 0.53 | 0.03 | 0.21 |
| n | 0.16 | 1.02 | 0.40 | 0.35 | 0.013 | 0.006 | 0.65 | 0.32 | 0 | 0.15 |
| o | 0.09 | 0.51 | 2.61 | 0.32 | 0.015 | 0.003 | 0.51 | 0.16 | 0 | 0.06 |
| p | 0.15 | 0.15 | 1.51 | 1.62 | 0.007 | 0.006 | 0.81 | 0.63 | 0 | 0.12 |
| q | 0.12 | 1.62 | 1.52 | 0.62 | 0.015 | 0.007 | 0.92 | 0.16 | 0 | 0.15 |
| r | 0.15 | 0.58 | 1.62 | 0.62 | 0.035 | 0.004 | 0.68 | 0.34 | 0 | 0.15 |
| s | 0.17 | 0.63 | 1.45 | 0.72 | 0.009 | 0.041 | 0.76 | 0.15 | 0 | 0.16 |
| t | 0.12 | 0.62 | 1.45 | 0.62 | 0.009 | 0.002 | 0.06 | 0 | 0 | 0.12 |
| u | 0.14 | 0.58 | 1.23 | 0.73 | 0.009 | 0.002 | 2.12 | 0.23 | 0 | 0.12 |

TABLE 2-continued

| | Components (weight %) | | | | | | | | | |
|---|---|---|---|---|---|---|---|---|---|---|
| | C | Si | Mn | Al | P | S | Ni | Cu | Sn | Mo |
| v | 0.16 | 0.72 | 1.32 | 0.45 | 0.015 | 0.005 | 0.53 | 0.22 | 0 | 0.02 |
| w | 0.15 | 0.36 | 1.25 | 0.82 | 0.012 | 0.006 | 0.62 | 0 | 0.05 | 0.62 |
| x | 0.10 | 1.05 | 1.13 | 0.32 | 0.015 | 0.003 | 0.92 | 0.12 | 0 | 0.04 |
| y | 0.16 | 0.83 | 1.52 | 0.87 | 0.008 | 0.002 | 0.15 | 0.05 | 0 | 0.12 |

TABLE 3

| | Components (weight %) | | | | |
|---|---|---|---|---|---|
| | Si + Al | Ni + Cu + 3Sn | 1/5Si + 1/10A | Other added elements | Remarks |
| a | 1.19 | 0.51 | 0.18 | — | Invention example |
| b | 1.25 | 0.78 | 0.24 | — | Invention example |
| c | 1.61 | 1.06 | 0.31 | — | Invention example |
| d | 1.25 | 0.87 | 0.19 | — | Invention example |
| e | 1.57 | 1.07 | 0.30 | — | Invention example |
| f | 1.28 | 1.35 | 0.19 | — | Invention example |
| g | 1.22 | 0.78 | 0.21 | Cr: 0.2 | Invention example |
| h | 1.40 | 0.75 | 0.18 | REM: 0.005, Ca: 0.006 | Invention example |
| i | 1.27 | 0.97 | 0.21 | Ti: 0.05, Nb: 0.02 | Invention example |
| j | 1.36 | 1.44 | 0.15 | V: 0.1, Mg: 0.02 | Invention example |
| k | 0.67 | 0.86 | 0.11 | — | Comparative example |
| l | 1.35 | 0.80 | 0.16 | Ti: 0.02, V: 0.05 | Comparative example |
| m | 1.95 | 1.57 | 0.39 | B: 0.003, Ca: 0.005 | Comparative example |
| n | 1.37 | 0.97 | 0.24 | — | Comparative example |
| o | 0.83 | 0.67 | 0.13 | — | Comparative example |
| p | 1.77 | 1.44 | 0.19 | — | Comparative example |
| q | 2.24 | 1.08 | 0.39 | — | Comparative example |
| r | 1.20 | 1.02 | 0.18 | Zr: 0.02 | Comparative example |
| s | 1.35 | 0.91 | 0.20 | — | Comparative example |
| t | 1.24 | 0.06 | 0.19 | — | Comparative example |
| u | 1.31 | 2.35 | 0.19 | — | Comparative example |
| v | 1.17 | 0.75 | 0.19 | Cr: 0.1, Ti: 0.01, Mg: 0.01 | Comparative example |
| w | 1.18 | 0.77 | 0.15 | — | Comparative example |
| x | 1.37 | 1.04 | 0.24 | B: 0.005 | Comparative example* |
| y | 1.70 | 0.20 | 0.25 | | Comparative example** |

Note:

The underlined numerals means that they are outside the ranges stipulated in the present invention. Here, the mark * shows that the relationship between Mo and Ni does not fulfill the regulation stipulated in the present invention and the mark ** that the relationship between the group of Si and Al and the group of Ni, Cu and Sn does not.

TABLE 4

| | Steel | Heating temperature (° C.) | Heating time (min.) | Coiling temperature (° C.) | Cold-rolling reduction ratio (%) | Annealing temperature (° C.) | Anneling time (sec.) | Cooling rate (° C./sec.) |
|---|---|---|---|---|---|---|---|---|
| 1 | a | 1250 | 50 | 700 | 70 | 810 | 100 | 10 |
| 2 | a | 1200 | 60 | 680 | 65 | 800 | 80 | 30 |
| 3 | a | 1180 | 80 | 720 | 70 | 820 | 120 | 8 |
| 4 | a | 1230 | 70 | 550 | 70 | 800 | 230 | 15 |
| 5 | a | 1200 | 60 | 680 | 75 | 820 | 150 | 20 |
| 6 | b | 1270 | 50 | 650 | 60 | 780 | 90 | 25 |
| 7 | c | 1210 | 80 | 660 | 75 | 850 | 50 | 60 |
| 8 | d | 1160 | 100 | 600 | 50 | 810 | 80 | 150 |
| 9 | e | 1190 | 80 | 700 | 60 | 770 | 130 | 3 |
| 10 | f | 1260 | 55 | 450 | 50 | 820 | 330 | 15 |
| 11 | g | 1200 | 70 | 700 | 60 | 790 | 130 | 30 |
| 12 | h | 1170 | 70 | 600 | 65 | 820 | 60 | 15 |
| 13 | i | 1190 | 60 | 770 | 70 | 830 | 250 | 8 |
| 14 | j | 1160 | 80 | 650 | 75 | 790 | 80 | 50 |
| 15 | k | 1200 | 70 | 700 | 70 | 830 | 30 | 100 |
| 16 | l | 1250 | 60 | 600 | 70 | 820 | 60 | 30 |
| 17 | m | 1220 | 80 | 630 | 68 | 790 | 100 | 10 |
| 18 | n | 1190 | 90 | 750 | 40 | 800 | 90 | 60 |
| 19 | o | 1200 | 60 | 450 | 50 | 770 | 100 | 15 |
| 20 | p | 1160 | 70 | 620 | 70 | 850 | 30 | 5 |
| 21 | q | 1260 | 50 | 570 | 60 | 820 | 70 | 100 |
| 22 | r | 1190 | 80 | 660 | 75 | 820 | 160 | 30 |
| 23 | s | 1240 | 70 | 700 | 70 | 830 | 90 | 20 |
| 24 | t | 1210 | 80 | 660 | 75 | 850 | 50 | 60 |
| 25 | u | 1250 | 50 | 700 | 70 | 810 | 100 | 10 |
| 26 | v | 1230 | 50 | 480 | 66 | 810 | 280 | 45 |
| 27 | w | 1190 | 60 | 620 | 50 | 790 | 160 | 80 |
| 28 | x | 1260 | 50 | 550 | 75 | 820 | 30 | 30 |
| 29 | y | 1200 | 60 | 600 | 60 | 800 | | |
| 30 | a | 1140 | 80 | 760 | 60 | 810 | 130 | 70 |

TABLE 5

| | Steel | Retention temperature before plating (° C.) | Retention time (sec.) | Plating temperature (° C.) | Alloying temperature (° C.) | Alloying time (sec.) | Cooling rate (° C./sec.) | Cooling temperature (° C.) |
|---|---|---|---|---|---|---|---|---|
| 1 | a | — | — | 440 | — | — | 10 | 180 |
| 2 | a | 400-450 | 60 | 450 | — | — | 20 | 180 |
| 3 | a | 400-450 | 30 | 430 | — | — | 10 | 150 |
| 4 | a | — | — | 450 | 530 | 20 | 8 | 200 |
| 5 | a | 400-450 | 10 | 460 | 500 | 25 | 16 | 150 |
| 6 | b | — | — | 440 | 480 | 60 | 10 | 130 |
| 7 | c | — | — | 430 | — | — | 8 | 200 |
| 8 | d | — | — | 470 | 500 | 30 | 12 | 180 |
| 9 | e | 360-440 | 30 | 460 | 510 | 25 | 10 | 210 |
| 10 | f | — | — | 450 | — | — | 20 | 180 |
| 11 | g | — | — | 430 | — | — | 10 | 220 |
| 12 | h | — | — | 450 | 500 | 30 | 15 | 180 |
| 13 | i | — | — | 440 | — | — | 10 | 150 |
| 14 | j | — | — | 450 | 480 | 50 | 7 | 200 |
| 15 | k | 350-400 | 290 | 430 | 500 | 25 | 10 | 160 |
| 16 | l | — | — | 450 | — | — | 20 | 130 |
| 17 | m | — | — | 460 | 520 | 20 | 10 | 200 |
| 18 | n | 400-450 | 40 | 440 | — | — | 15 | 180 |
| 19 | o | — | — | 430 | 550 | 10 | 7 | 210 |
| 20 | p | — | — | 470 | — | — | 10 | 180 |
| 21 | q | 400-490 | 15 | 460 | 480 | 40 | 12 | 150 |
| 22 | r | — | — | 450 | 580 | 10 | 10 | 200 |
| 23 | s | — | — | 430 | 500 | 30 | 20 | 15 |
| 24 | t | — | — | 430 | — | — | 8 | 200 |
| 25 | u | — | — | 440 | — | — | 10 | 180 |
| 26 | v | — | — | 440 | 530 | 20 | 10 | 130 |
| 27 | w | 360-440 | 60 | 450 | 520 | 22 | 8 | 200 |
| 28 | x | — | — | 430 | 510 | 25 | 20 | 180 |
| 29 | y | | — | | | | | |
| 30 | a | — | — | 430 | 480 | 30 | 7 | 180 |

Note:

The underlined numerals means that they are outside the ranges stipulated in the present invention. Here, the heating rate after plating is kept constant at 10° C./sec. The products to which alloying treatment is not applied are hot-dip galvanized steel sheets.

TABLE 6

| | Steel | Heating temperature (° C.) | Heating time (min.) | Coiling temperature (° C.) | Cold-rolling reduction ratio (%) | Annealing temperature (° C.) | Anneling time (sec.) | Cooling rate (° C./sec.) |
|---|---|---|---|---|---|---|---|---|
| 31 | a | 1240 | 40 | 630 | 65 | 780 | 50 | 30 |
| 32 | a | 1160 | 90 | 380 | 75 | 830 | 90 | 15 |
| 33 | a | 1200 | 60 | 790 | 70 | 790 | 220 | 40 |
| 34 | a | 1280 | 60 | 620 | 30 | 830 | 80 | 60 |
| 35 | a | 1260 | 80 | 580 | 55 | 720 | 150 | 10 |
| 36 | a | 1250 | 60 | 720 | 60 | 920 | 90 | 100 |
| 37 | a | 1160 | 60 | 550 | 75 | 760 | 5 | 6 |
| 38 | a | 1170 | 70 | 640 | 60 | 820 | 380 | 130 |
| 39 | a | 1160 | 100 | 600 | 50 | 810 | 80 | 1 |
| 40 | a | 1190 | 80 | 700 | 60 | 770 | 130 | 10 |
| 41 | a | 1260 | 55 | 450 | 50 | 820 | 330 | 60 |
| 42 | a | 1200 | 70 | 700 | 60 | 780 | 130 | 15 |
| 43 | a | 1170 | 70 | 600 | 65 | 760 | 60 | 5 |
| 44 | a | 1190 | 60 | 770 | 70 | 830 | 250 | 100 |
| 45 | a | 1160 | 80 | 650 | 75 | 800 | 80 | 30 |
| 46 | a | 1200 | 70 | 700 | 70 | 830 | 30 | 20 |
| 47 | a | 1250 | 60 | 600 | 70 | 790 | 60 | 45 |
| 48 | a | 1120 | 80 | 630 | 68 | 810 | 100 | 80 |
| 49 | a | 1140 | 80 | 760 | 60 | 810 | 130 | 160 |
| 50 | a | 1240 | 40 | 630 | 65 | 790 | 50 | 30 |
| 51 | a | 1160 | 90 | 380 | 75 | 810 | 90 | 15 |
| 52 | a | 1200 | 60 | 790 | 70 | 770 | 220 | 40 |
| 53 | a | 1280 | 60 | 620 | 30 | 750 | 80 | 60 |
| 54 | a | 1260 | 80 | 580 | 55 | 720 | 150 | 10 |
| 55 | a | 1250 | 60 | 720 | 60 | 920 | 90 | 100 |
| 56 | a | 1160 | 60 | 550 | 75 | 760 | 5 | 6 |
| 57 | a | 1170 | 70 | 640 | 60 | 780 | 380 | 130 |
| 58 | a | 1190 | 60 | 600 | 65 | 820 | 160 | 1 |
| 59 | a | 1160 | 60 | 550 | 70 | 850 | 300 | 20 |
| 60 | a | 1200 | 70 | 600 | 80 | 820 | 90 | 60 |
| 61 | a | 1160 | 80 | 720 | 60 | 790 | 160 | 5 |
| 62 | a | 1190 | 60 | 580 | 65 | 840 | 130 | 3 |
| 63 | a | 1240 | 80 | 600 | 45 | 810 | 220 | 90 |

TABLE 7

| | Steel | Retention temperature before plating (° C.) | Retention time (sec.) | Plating temperature (° C.) | Alloying temperature (° C.) | Alloying time (sec.) | Cooling rate (° C./sec.) | Cooling temperature (° C.) |
|---|---|---|---|---|---|---|---|---|
| 31 | a | — | — | 440 | 550 | 20 | 10 | 210 |
| 32 | a | 400-450 | 20 | 450 | 500 | 30 | 20 | 180 |
| 33 | a | — | — | 430 | 460 | 60 | 10 | 220 |
| 34 | a | — | — | 450 | 520 | 40 | 8 | 180 |
| 35 | a | — | — | 460 | 500 | 30 | 16 | 250 |
| 36 | a | — | — | 450 | 480 | 40 | 10 | 180 |
| 37 | a | — | — | 430 | 500 | 20 | 10 | 250 |
| 38 | a | — | — | 450 | 550 | 15 | 12 | 180 |
| 39 | a | — | — | 460 | 480 | 30 | 10 | 170 |
| 40 | a | 300-350 | 15 | 440 | 550 | 10 | 15 | 180 |
| 41 | a | 480-530 | 5 | 430 | 510 | 15 | 7 | 220 |
| 42 | a | 360-440 | 350 | 470 | 520 | 20 | 10 | 180 |
| 43 | a | — | — | 460 | 430 | 60 | 12 | 250 |
| 44 | a | 400-450 | 30 | 450 | 620 | 50 | 10 | 180 |
| 45 | a | — | — | 430 | 550 | 5 | 10 | 250 |
| 46 | a | — | — | 440 | 520 | 70 | 12 | 180 |
| 47 | a | — | — | 450 | 500 | 20 | 3 | 180 |
| 48 | a | — | — | 450 | 510 | 20 | 15 | 300 |
| 49 | a | — | — | 430 | — | — | 7 | 150 |
| 50 | a | — | — | 440 | — | — | 10 | 200 |
| 51 | a | 400-450 | 20 | 450 | — | — | 12 | 180 |
| 52 | a | — | — | 430 | — | — | 10 | 180 |
| 53 | a | — | — | 450 | — | — | 18 | 150 |
| 54 | a | — | — | 460 | — | — | 10 | 180 |
| 55 | a | — | — | 450 | — | — | 10 | 180 |
| 56 | a | — | — | 430 | — | — | 10 | 150 |
| 57 | a | — | — | 450 | — | — | 20 | 200 |
| 58 | a | — | — | 460 | — | — | 10 | 170 |
| 59 | a | 300-350 | 15 | 440 | — | — | 12 | 130 |
| 60 | a | 480-530 | 5 | 430 | — | — | 10 | 200 |
| 61 | a | 360-440 | 400 | 470 | — | — | 15 | 180 |

TABLE 7-continued

| | Steel | Retention temperature before plating (° C.) | Retention time (sec.) | Plating temperature (° C.) | Alloying temperature (° C.) | Alloying time (sec.) | Cooling rate (° C./sec.) | Cooling temperature (° C.) |
|---|---|---|---|---|---|---|---|---|
| 62 | a | — | — | 440 | — | — | 3 | 210 |
| 63 | a | — | — | 450 | — | — | 10 | 300 |

Note:

The underlined numerals means that they are outside the ranges stipulated in the present invention. Here, the heating rate after plating is kept constant at 10° C./sec. The products to which alloying treatment is not applied are hot-dip galvanized steel sheets.

TABLE 8

| | TS (MPa) | El (%) | Retained γ (%) | Plating appearance | Plating adhesiveness | Weld-ability | Fe in plating (%) | Remarks |
|---|---|---|---|---|---|---|---|---|
| 1 | 650 | 36 | 8.2 | ◎ | ◎ | ○ | — | Invention example |
| 2 | 640 | 37 | 9.1 | ◎ | ◎ | ○ | — | Invention example |
| 3 | 630 | 37 | 8.6 | ◎ | ◎ | ○ | — | Invention example |
| 4 | 610 | 34 | 6.2 | ◎ | ◎ | ○ | 11.5 | Invention example |
| 5 | 620 | 35 | 7.1 | ◎ | ◎ | ○ | 10.3 | Invention example |
| 6 | 630 | 35 | 5.6 | ◎ | ◎ | ○ | 9.4 | Comparative example |
| 7 | 830 | 31 | 7.2 | ◎ | ◎ | ○ | — | Invention example |
| 8 | 810 | 28 | 8.2 | ◎ | ◎ | ○ | 10.2 | Invention example |
| 9 | 1060 | 18 | 8.1 | ○ | ○ | ○ | 10.2 | Invention example |
| 10 | 1040 | 20 | 10.2 | ◎ | ◎ | ○ | — | Invention example |
| 11 | 640 | 38 | 6.2 | ◎ | ◎ | ○ | — | Invention example |
| 12 | 630 | 34 | 8.1 | ○ | ○ | ○ | 11.1 | Invention example |
| 13 | 810 | 32 | 7.6 | ◎ | ◎ | ○ | — | Invention example |
| 14 | 1060 | 19 | 15 | ○ | ○ | ○ | 9.8 | Invention example |
| 15 | 600 | 26 | 1.6 | ◎ | ◎ | ○ | 10.1 | Comparative example |
| 16 | 1030 | 20 | 18 | ◎ | ◎ | X | — | Comparative example |
| 17 | 860 | 30 | 11 | X | X | ○ | 12.1 | Comparative example |
| 18 | 810 | 18 | 1.3 | ◎ | ◎ | ○ | — | Comparative example |
| 19 | 710 | 29 | 4.6 | ◎ | ◎ | X | 13.5 | Comparative example |
| 20 | 650 | 35 | 8.6 | X | X | ○ | — | Comparative example |
| 21 | 920 | 25 | 5.2 | X | X | ○ | 8.5 | Comparative example |
| 22 | 850 | 28 | 5.6 | ◎ | ◎ | X | 14.2 | Comparative example |
| 23 | 840 | 29 | 7.1 | ◎ | ◎ | X | 10.5 | Comparative example |
| 24 | 610 | 35 | 7.2 | X | X | ○ | — | Comparative example |
| 25 | 810 | 16 | 22 | ◎ | ◎ | ○ | — | Comparative example |
| 26 | 810 | 22 | 1.3 | ◎ | ◎ | ○ | 10.6 | Comparative example |
| 27 | 1060 | 26 | 5.6 | ○ | ○ | ○ | 11.2 | Comparative example |
| 28 | 620 | 28 | 1.7 | ○ | ○ | ○ | 9.8 | Comparative example |
| 29 | 850 | 26 | 13 | X | X | ○ | 1.5 | Comparative example |
| 30 | 640 | 35 | 5.5 | X | X | ○ | 9.2 | Comparative example |

TABLE 9

| | TS (MPa) | El (%) | Retained γ (%) | Plating appearance | Plating adhesiveness | Weld-ability | Fe in plating (%) | Remarks |
|---|---|---|---|---|---|---|---|---|
| 31 | 620 | 35 | 6.3 | X | X | ○ | 13.5 | Comparative example |
| 32 | 630 | 34 | 5.3 | X | X | ○ | 10.5 | Comparative example |
| 33 | 625 | 34 | 3.5 | Δ | Δ | ○ | 9.6 | Comparative example |
| 34 | 610 | 29 | 0.6 | ◎ | ◎ | ○ | 12.2 | Comparative example |
| 35 | 650 | 26 | 1.8 | ◎ | ◎ | ○ | 10.5 | Comparative example |
| 36 | 580 | 30 | 1.5 | ○ | ○ | ○ | 9.1 | Comparative example |
| 37 | 630 | 29 | 1.2 | ○ | ○ | ○ | 10.1 | Comparative example |
| 38 | 635 | 28 | 1 | ◎ | ◎ | ○ | 13.2 | Comparative example |
| 39 | 640 | 26 | 0 | ○ | ○ | ○ | 8.3 | Comparative example |
| 40 | 645 | 27 | 1.2 | ◎ | ◎ | ○ | 12.5 | Comparative example |
| 41 | 630 | 25 | 0 | ◎ | ◎ | ○ | 10.3 | Comparative example |
| 42 | 635 | 26 | 0.5 | ◎ | ◎ | ○ | 12.1 | Comparative example |
| 43 | 630 | 36 | 5.3 | ○ | ○ | ○ | 5.3 | Comparative example |
| 44 | 625 | 25 | 0.3 | ◎ | ◎ | ○ | 16.5 | Comparative example |
| 45 | 630 | 30 | 1.6 | ○ | ○ | ○ | 5.1 | Comparative example |
| 46 | 620 | 26 | 0.8 | ◎ | ◎ | ○ | 15.6 | Comparative example |
| 47 | 620 | 26 | 0.5 | ◎ | ◎ | ○ | 9.8 | Comparative example |
| 48 | 630 | 28 | 1.1 | ◎ | ◎ | ○ | 10.5 | Comparative example |
| 49 | 645 | 34 | 5.3 | X | X | ○ | — | Comparative example |
| 50 | 622 | 35 | 6.5 | X | X | ○ | — | Comparative example |
| 51 | 635 | 33 | 5.5 | X | X | ○ | — | Comparative example |
| 52 | 620 | 33 | 3.3 | Δ | Δ | ○ | — | Comparative example |
| 53 | 615 | 28 | 0.7 | ◎ | ◎ | ○ | — | Comparative example |
| 54 | 645 | 26 | 1.3 | ◎ | ◎ | ○ | — | Comparative example |
| 55 | 575 | 28 | 1.6 | ◎ | ◎ | ○ | — | Comparative example |
| 56 | 625 | 27 | 1.1 | ○ | ○ | ○ | — | Comparative example |
| 57 | 640 | 26 | 0.8 | ◎ | ◎ | ○ | — | Comparative example |
| 58 | 635 | 25 | 0 | ◎ | ◎ | ○ | — | Comparative example |
| 59 | 640 | 26 | 1.1 | ○ | ○ | ○ | — | Comparative example |
| 60 | 635 | 26 | 0 | ◎ | ◎ | ○ | — | Comparative example |
| 61 | 630 | 25 | 0.6 | ○ | ○ | ○ | — | Comparative example |
| 62 | 625 | 24 | 0.7 | ◎ | ◎ | ○ | — | Comparative example |
| 63 | 635 | 27 | 0.9 | ◎ | ◎ | ○ | — | Comparative example |

Example 3

Using a hot-dip plating simulator, various kinds of hot-dip galvanized steel sheets were produced by subjecting cold-rolled steel sheets having the components of the invention example No. 2 in Table 7 to the processes of: annealing for 100 sec. at 800° C. at a heating rate of 5° C./sec. in the atmospheres shown in Table 8; subsequently dipping in a hot-dip galvanizing bath; and air cooling to the room temperature. Here, an atmosphere at the time of heating was controlled to 4% hydrogen and −40° C. dew point, and a metal composed of zinc containing 0.14% Al was used in a hot-dip galvanizing bath. Further, the dipping time was set at 4 sec. and the dipping temperature was set at 460° C.

The plating performance of the hot-dip galvanized steel sheets thus produced was evaluated visually. The evaluation results were classified by the marks, ○: a portion having good appearance and no non-plated portion, Δ: a portion partially having small non-plated portions 1 mm or less in size, X: a portion partially having non-plated portions over 1 mm in size, and XX: a portion not plated at all, and the marks ○ and Δ were regarded as acceptable. Further, the adhesiveness of hot-dip galvanizing was evaluated by exfoliation of a specimen with a tape after 0T bending and the evaluation results were classified by the marks, ○: no exfoliation, Δ: somewhat exfoliated, and X: considerably exfoliated, and the marks ○ and Δ were regarded as acceptable. The area ratio of oxides on a steel sheet surface 10 was determined in a visual field by of 1 mm×1 mm with SEM after a plating layer of the plated steel sheet is dissolved by fuming nitric acid. In this measurement, in consideration of the fact that an oxide layer looked black when the oxide layer was observed by the secondary electron image of SEM was defined as the area ratio of oxides. The results are shown in Table 10. Table 10 includes the lower and upper limit of hydrogen concentration obtained by the dew-point claimed in claim 9.

It is understood that, in the examples 6-10 satisfying the requirements stipulated in the present invention, excellent plating performance is obtained. In contrast, in the examples 7-10 not satisfying the atmosphere requirements stipulated in the present invent, the area ratios of oxides are low and thus excellent plating performance cannot be obtained.

Example 4

Using a hot-dip plating simulator, various kinds of hot-dip galvanized steel sheets were produced by subjecting cold-rolled steel sheets having the components of the invention example No. 5 in Table 8 to the processes of: annealing for 100 sec. at 800° C. at a heating rate of 5° C./sec. in the atmospheres shown in Table 11; subsequently dipping in a hot-dip galvanizing bath; and air cooling to the room temperature. Here, a metal composed of zinc containing 0.14% Al was used in a hot-dip galvanizing bath. Further, the dipping time was set at 4 sec. ad the dipping temperature was set at 460° C.

The plating performance of the hot-dip galvanized steel sheets thus produced was evaluated visually. The evaluation results were classified by the marks, ○: no non-plated portion and X: having non-plated portions. Further, the adhesiveness of hot-dip galvanizing was evaluated by exfoliation of a specimen with a tape after 0T bending and the evaluation results were classified by the marks, ○: no exfoliation and X: exfoliated. The area ratio of oxides on a steel sheet surface was determined in a visual field by of 1 mm×1 mm with SEM after a plating layer of the plated steel sheet is dissolved by fuming nitric acid. In this measurement, in consideration of the fact that an oxide layer looked black when the oxide layer was observed by the secondary electron image of SEM was defined as the area ratio of oxides. The results are shown in Table 11. Table 11 includes the lower and upper limit of hydrogen concentration obtained by the dew-point and the Ni content claimed in claim 10.

It is understood that, in the examples 1-5 satisfying the requirements stipulated in the present invention, excellent plating performance is obtained. In contrast, in the examples 6-8 not satisfying the atmosphere requirements stipulated in the present invent, the area ratios of oxides are low and thus excellent plating performance cannot be obtained.

TABLE 10

| No. | Oxygen concentration during heating (ppm) | Annealing atmosphere at 800° C. Oxygen (ppm) | Hydrogen (%) | Dew point (° C.) | Hydrogen concentration derived from CLAIMS Lower limit (%) | Upper limit (%) | Area ratio of oxides (%) | Plating performance | Plating adhesiveness | Remarks |
|---|---|---|---|---|---|---|---|---|---|---|
| 1 | 10 | 5 | 4 | −40 | 0.4 | 36.6 | 25 | ○ | ○ | Invention |
| 2 | 20 | 3 | 6 | −50 | 0.1 | 13.5 | 45 | ○ | ○ | example |
| 3 | 30 | 10 | 4 | −15 | 4.5 | 100.0 | 30 | ○ | ○ | |
| 4 | 10 | 6 | 8 | −20 | 2.7 | 100.0 | 20 | ○ | ○ | |
| 5 | 20 | 3 | 3 | −50 | 0.1 | 13.5 | 65 | ○ | ○ | |
| 6 | 10 | 2 | 6 | 0 | 20.0 | 100.0 | 15 | ○ | ○ | |
| 7 | 60 | 15 | 5 | −40 | 0.4 | 36.6 | 95 | X | X | Comparative |
| 8 | 30 | 40 | 4 | −40 | 0.4 | 36.6 | 90 | X | X | example |
| 9 | 10 | 5 | 6 | −60 | 0.0 | 5.0 | 2 | X | X | |
| 10 | 20 | 10 | 5 | 10 | 54.4 | 100.0 | 85 | X | X | |
| 11 | 10 | 7 | 40 | −40 | 0.4 | 36.6 | 3 | X | X | |

Note:

The underlined numerals are outside the ranges stipulated in the present invention.

TABLE 11

| Condition | Annealing atmosphere Hydrogen (%) | Annealing atmosphere Dew point (° C.) | Hydrogen concentration derived from CLAIMS Lower limit (%) | Hydrogen concentration derived from CLAIMS Upper limit (%) | Area ratio of oxides (%) | Plating performance | Plating adhesiveness | Remarks |
|---|---|---|---|---|---|---|---|---|
| 1 | 4 | −40 | 0.05 | 34.50 | 45 | ○ | ○ | Invention example |
| 2 | 4 | −15 | 0.63 | 100.00 | 25 | ○ | ○ | Invention example |
| 3 | 8 | −20 | 0.38 | 100.00 | 35 | ○ | ○ | Invention example |
| 4 | 3 | −50 | 0.02 | 12.69 | 55 | ○ | ○ | Invention example |
| 5 | 6 | 0 | 2.83 | 100.00 | 15 | ○ | ○ | Invention example |
| 6 | 5 | −60 | 0.01 | 4.67 | 3 | X | X | Comparative example |
| 7 | 5 | 10 | 7.68 | 100.00 | 95 | X | X | Comparative example |
| 8 | 40 | −40 | 0.05 | 34.50 | 2 | X | X | Comparative example |

Example 5

Using a hot-dip plating simulator, various kinds of hot-dip galvanized steel sheets were produced by subjecting various steel sheets shown in Table 3 to the processes of: annealing for 100 sec. at 800° C. at a heating rate of 5° C./sec. in an atmosphere of 5 ppm oxygen, 4% hydrogen and −40° C. dew point; subsequently dipping in a hot-dip galvanizing bath; and air cooling to the room temperature. Here, an atmosphere at the time of heating was controlled to 5 ppm oxygen, 4% hydrogen and −40° C. dew point in the same way as the case of the retention at 800° C., and a metal composed of zinc containing 0.14% Al was used in a hot-dip galvanizing bath. Further, the dipping time was set at 4 sec. and the dipping temperature was set at 460° C.

The plating performance of the hot-dip galvanized steel sheets thus produced was evaluated visually. The evaluation results were classified by the marks, ○: a portion having good appearance and no non-plated portion, Δ: a portion partially having small non-plated portions 1 mm or less in size, X: a portion partially having non-plated portions over 1 mm in size, and XX: a portion not plated at all, and the marks ○ and Δ were regarded as acceptable. Further, the adhesiveness of hot-dip galvanizing was evaluated by exfoliation of a specimen with a tape after 0T bending and the evaluation results were classified by the marks, ○: no exfoliation, Δ: somewhat exfoliated, and X: considerably exfoliated, and the marks ○ and Δ were regarded as acceptable. Furthermore, in the investigation of the maximum length of oxides in a steel sheet surface layer, the maximum length was determined by observing a section in the region of 1 mm or more, without applying etching, of a plated steel sheet under a magnification of 40,000 with an SEM and regarding the length of a portion where a gap between oxides exists continuously as the maximum length. The evaluation was made observing three portions of each specimen. The results, together with the components of the steel sheets, are shown in Table 12.

TABLE 12

| No. | Steel sheet components (mass %) C | Si | Al | Mn | Cr | Others | Maximum oxide length (μm) | Plating performance | Plating adhesiveness | Remarks |
|---|---|---|---|---|---|---|---|---|---|---|
| 1 | 0.13 | 0.05 | 0.92 | 1.5 | — | Mo: 0.12 | 0.5 | ○ | ○ | Invention example |
| 2 | 0.08 | 0.45 | 0.03 | 2.1 | 0.02 | | 0.4 | ○ | ○ | |
| 3 | 0.13 | 1.40 | 0.03 | 1.6 | — | Ni: 0.8, Cu: 0.2 | 1.2 | ○ | Δ | |
| 4 | 0.07 | 0.06 | 0.06 | 1.2 | 0.42 | | 1.0 | ○ | ○ | |
| 5 | 0.13 | 0.61 | 0.58 | 1.3 | — | Ni: 0.7, Mo: 0.15 | 2.1 | Δ | Δ | |
| 6 | 0.22 | 0.11 | 0.92 | 1.4 | — | Mo: 0.15 | 0.6 | ○ | ○ | |
| 7 | 0.21 | 0.08 | 1.60 | 1.3 | 0.20 | | 1.1 | ○ | Δ | |
| 8 | 0.18 | 0.82 | 0.46 | 1.7 | — | Mo: 0.18, Cu: 0.3 | 0.7 | ○ | ○ | |
| 9 | 0.11 | 0.90 | 0.60 | 1.2 | — | Cu: 0.3 | 0.3 | ○ | ○ | |
| 10 | 0.09 | 1.21 | 0.05 | 1.2 | — | Ni: 0.6, Cu: 0.2, Sn: 0.03 | 0.8 | ○ | ○ | |
| 11 | 0.15 | 0.25 | 1.62 | 1.2 | — | Ni: 0.2, Mo: 0.1 | 0.6 | ○ | ○ | |
| 12 | 0.06 | 0.62 | 0.03 | 2.1 | 0.15 | | 0.4 | ○ | ○ | |
| 13 | 0.03 | 0.40 | 0.50 | 0.7 | 0.24 | Sn: 0.05 | 0.4 | ○ | ○ | |
| 14 | 0.16 | 2.21 | 0.03 | 1.5 | — | Mo: 0.3 | 3.6 | X | X | Comparative example |
| 15 | 0.24 | 0.15 | 2.15 | 0.7 | 0.12 | Cu: 0.7, Sn: 0.05 | 3.2 | X | X | |
| 16 | 0.06 | 0.10 | 0.06 | 2.6 | — | | 3.8 | X | X | |

It is understood that, in the invention examples Nos. 1 to 13 satisfying the requirements stipulated in the present invention, the maximum length of oxides in a steel sheet surface layer is 3 μm or less and excellent plating performance is obtained. In contrast, since the Si content is high in the comparative example No. 14, the Al concentration is high in the comparative example No. 15 and the Mn concentration is high in the comparative example No. 16, the maximum length of oxides exceeds 3 μm and resultantly good plating performance is not obtained.

Example 6

Using a hot-dip plating simulator, various kinds of hot-dip galvanized steel sheets were produced by subjecting various steel sheets shown in Table 9 to the processes of: annealing for 100 sec. at 800° C. at a heating rate of 5° C./sec. in an atmosphere of 4% hydrogen and −30° C. dew point; subsequently dipping in a hot-dip galvanizing bath; and air cooling to the room temperature. Here, a metal composed of zinc containing 0.14% Al was used in a hot-dip galvanizing bath. Further, the dipping time was set at 4 sec. and the dipping temperature was set at 460° C.

The plating performance of the hot-dip galvanized steel sheets thus produced was evaluated visually. The evaluation results were classified by the marks, ○: no non-plated portion and X: having non-plated portions. Further, the adhesiveness of hot-dip galvanizing was evaluated by exfoliation of a specimen with a tape after 0T bending and the evaluation results were classified by the marks, ○: no exfoliation and X: exfoliated. Furthermore, existence or not of an internal oxide layer immediately under a hot-dip plating layer was determined by observing a section, after polished, of a plated steel sheet under the magnification of 10,000 with a scanning electron microscope (SEM). The results of the evaluation of an internal oxide layer was classified by the marks, ○: an internal oxide layer observed and X: an internal oxide layer not observed. The results, together with the components of the steel sheets, are shown in Table 13.

It is understood that, in the invention examples Nos. 1 to 11 satisfying the requirements stipulated in the present invention, internal oxidization is observed in a steel sheet surface layer and excellent plating performance is obtained. In contrast, since the Si content is high in the comparative example No. 12, the Al concentration is high in the comparative example No. 13 and the Mn concentration is high in the comparative example No. 14, though an internal oxide layer is formed, good plating performance is not obtained. Further, since the Ni concentration is low in the comparative example No. 15, an internal oxide layer is not formed and good plating performance is not obtained.

TABLE 13

| | Steel sheet components (weight %) | | | | | | Existence of internal | Plating | Plating | |
|---|---|---|---|---|---|---|---|---|---|---|
| Condition | C | Si | Al | Mn | Ni | Others | oxidization | performance | adhesiveness | Remarks |
| 1 | 0.05 | 0.30 | 0.03 | 1.2 | 0.15 | | ○ | ○ | ○ | Invention example |
| 2 | 0.08 | 0.45 | 0.03 | 2.1 | 0.06 | | ○ | ○ | ○ | Invention example |
| 3 | 0.09 | 1.70 | 0.25 | 1.6 | 0.80 | Cu: 0.2 | ○ | ○ | ○ | Invention example |
| 4 | 0.10 | 1.21 | 0.06 | 1.23 | 0.42 | | ○ | ○ | ○ | Invention example |
| 5 | 0.13 | 0.61 | 0.58 | 1.05 | 0.60 | Mo: 0.15 | ○ | ○ | ○ | Invention example |
| 6 | 0.21 | 0.08 | 1.60 | 1.3 | 0.20 | | ○ | ○ | ○ | Invention example |
| 7 | 0.18 | 0.82 | 0.46 | 1.67 | 0.72 | Mo: 0.18, Cu: 0.3 | ○ | ○ | ○ | Invention example |
| 8 | 0. 11 | 0.90 | 0.60 | 1.2 | 0.60 | Cu: 0.3 | ○ | ○ | ○ | Invention example |
| 9 | 0.15 | 0.25 | 1.62 | 1.2 | 0.80 | Mo: 0.1 | ○ | ○ | ○ | Invention example |
| 10 | 0.06 | 0.24 | 1.20 | 2.4 | 0.15 | | ○ | ○ | ○ | Invention example |
| 11 | 0.03 | 0.40 | 0.50 | 0.7 | 0.24 | Sn: 0.05 | ○ | ○ | ○ | Invention example |
| 12 | 0.16 | 2.21 | 0.03 | 1.5 | 0.95 | Mo: 0.3 | ○ | X | X | Comparative example |
| 13 | 0.24 | 0.15 | 2.15 | 0.7 | 0.90 | Cu: 0.7, Sn: 0.05 | ○ | X | X | Comparative example |
| 14 | 0.06 | 0.10 | 0.06 | 2.6 | 0.95 | | ○ | X | X | Comparative example |

INDUSTRIAL APPLICABILITY

As explained above, the present invention makes it possible to provide a high-strength hot-dip galvanized steel sheet having a tensile strength of about 590 to 1,080 MPa and a good press formability, and to produce the steel sheet in great efficiency.

The invention claimed is:

1. A method for producing a high-strength hot-dip galvanized steel sheet by using an equipment having only a reduction annealing furnace comprising:

providing a hot-rolled and cold-rolled steel sheet, with said steel sheet containing, by weight:

C: 0.03 to 0.25%,

Si: 0.05 to 2.0%,

Mn: 0.5 to 2.5%,

P: 0.03% or less,

S: 0.02% or less,

Al: 0.01 to 2.0%,

Ni: 0.01 to 0.15%, and balance Fe and unavoidable impurities;

with the relationship among Si, Mn and Al satisfying the following expression, $$Si+Al+Mn \geqq 1.0\%;$$

regulating an oxygen concentration of 100 ppm or less in a temperature range of lower than 400° C.;

subjecting the steel sheet to a treatment in an atmosphere having an oxygen concentration of 50 ppm or less in a temperature range of 400° C. to 750° C.;

annealing said hot-rolled and cold-rolled steel sheet for 10 sec. to 6 min. in a dual phase coexisting temperature range of 750° C. to 900° C.;

subjecting said steel sheet to another treatment for 30 sec. or longer in a temperature range of 750° C. or higher in an atmosphere wherein hydrogen concentration, dew point and oxygen concentration in said atmosphere are defined by H (%), D (° C.) and O (ppm), respectively, with H, D and O satisfying the following expressions:

$$2\ ppm \leqq O \leqq 30\ ppm, \text{ and}$$

$$20 \times \exp(0.1 \times D) \leqq H \leqq 2{,}000 \times \exp(0.1 \times D);$$

forming oxides including one or more of Si, Mn and Al and having a length of 3 μm or less on the surface of said steel sheet with an area ratio of 5% to 80%, subsequently cooling said annealed steel sheet to 350° C. to 500° C. at a cooling rate of 2 to 200° C./sec.;

subsequently dipping said cooled steel sheet into a hot-dip galvanizing bath after annealing to form a hot-dip galvanizing layer on each surface of said steel sheet;

cooling said hot-dip galvanized steel sheet to 250° C. or lower at a cooling rate of 5° C./sec. or more;

wherein retained austenite in said steel sheet is 2 to 20% by volume ratio.

2. A method for producing a high-strength hot-dip galvanized steel sheet by using an equipment having only a reduction annealing furnace comprising:

providing a hot-rolled and cold-rolled steel sheet, with said steel sheet containing, by weight:

C: 0.03 to 0.25%,

Si: 0.05 to 2.0%,

Mn: 0.5 to 2.5%,

P: 0.03% or less,

S: 0.02% or less,

Al: 0.01 to 2.0%,

Ni: 0.01 to 0.15%,

Cu: 0.01 to 1.0%,

Sn: 0.01 to 0.10%, and balance Fe and unavoidable impurities;

with the relationship among Si, Mn and Al satisfying the following expression, $$Si+Al+Mn \geqq 1.0\%;$$

the relationship among Ni, Cu and Sn satisfying the following expression, $$2 \times Ni(\%) > Cu(\%) + 3 \times Sn(\%);$$

the relationship among Si, Al, Ni, Cu and Sn satisfying the following expression, $$Ni(\%)+Cu(\%)+3 \times Sn(\%) \geqq \tfrac{1}{5} \times Si(\%) + \tfrac{1}{10} \times Al(\%);$$

regulating an oxygen concentration of 100 ppm or less in a temperature range of lower than 400° C.;

subjecting the steel sheet to a treatment in an atmosphere having an oxygen concentration of 50 ppm or less in a temperature range of 400° C. to 750° C.;

annealing said hot-rolled and cold-rolled steel sheet for 10 sec. to 6 min. in a dual phase coexisting temperature range of 750° C. to 900° C.;

subjecting said steel sheet to another treatment for 30 sec. or longer in a temperature range of 750° C. or higher in an atmosphere wherein hydrogen concentration, dew point and oxygen concentration in said atmosphere are defined by H (%), D (° C.) and O (ppm), respectively, with H, D and O satisfying the following expressions $$2\ ppm \leqq O \leqq 30\ ppm, \text{ and}$$

$$20 \times \exp(0.1 \times D) \leqq H \leqq 2{,}000 \times \exp(0.1 \times D);$$

forming oxides including one or more of Si, Mn and Al and having a length of 3 μm or less on the surface of said steel sheet with an area ratio of 5% to 80%, subsequently cooling said annealed steel sheet to 350° C. to 500° C. at a cooling rate of 2 to 200° C./sec.;

subsequently dipping said cooled steel sheet into a hit-dip galvanizing bath after annealing to form a hot-dip galvanizing layer on each surface of said steel sheet;

cooling said hot-dip galvanized steel sheet to 250° C. or lower at a cooling rate of 5° C./sec. or more;

wherein retained austenite in said steel sheet is 2 to 20% by volume ratio.

3. A method for producing a high-strength hot-dip galvanized steel sheet by using an equipment having only a reduction annealing furnace comprising:

providing a hot-rolled and cold-rolled steel sheet, with said steel sheet containing, by weight:

C: 0.03 to 0.25%,

Si: 0.05 to 2.0%,

Mn: 0.5 to 2.5%,

P: 0.03% or less,

S: 0.02% or less,

Al: 0.01 to 2.0%,

Ni: 0.01 to 0.15%, balance Fe and unavoidable impurities;

with the relationship among Si, Mn and Al satisfying the following expression, $$Si+Al+Mn \geqq 1.0\%;$$

regulating an oxygen concentration of 100 ppm or less in a temperature range of lower than 400° C.;

subjecting the steel sheet to a treatment in an atmosphere having an oxygen concentration of 50 ppm or less in a temperature range of 400° C. to 750° C.;

annealing said hot-rolled and cold-rolled steel sheet for 10 sec. to 6 min. in a dual phase coexisting temperature range of 750° C. to 900° C.;

subjecting said steel sheet to another treatment for 30 sec. or longer in a temperature range of 750° C. or higher in an atmosphere wherein hydrogen concentration, dew point and oxygen concentration in said atmosphere are defined by H (%), D (° C.) and O (ppm), respectively, with H, D and O satisfying the following, $$2\ ppm \leqq O \leqq 30\ ppm, \text{ and}$$

$$20 \times \exp(0.1 \times D) \leqq H \leqq 2{,}000 \times \exp(0.1 \times D);$$

forming oxides including one or more of Si, Mn and Al and having a length of 3 μm or less on the surface of said steel sheet with an area ratio of 5% to 80%, subsequently cooling said annealed steel sheet to 350° C. to 500° C. at a cooling rate of 2 to 200° C./sec.;

subsequently dipping said cooled steel sheet into a hot-dip galvanizing bath after annealing;

retaining said hot-dip galvanized steel sheet for 5 sec. to 2 min. in a temperature range of 450° C. to 600° C. to form an alloyed hot-dip galvanized layer containing 8 to 15 wt. % Fe on each surface of said steel sheet;

cooling said alloyed hot-dip galvanized steel sheet to 250° C. or lower at a cooling rate of 5° C./sec. or more;

wherein retained austenite in said steel sheet is 2 to 20% by volume ratio.

4. A method for producing a high-strength hot-dip galvanized steel sheet by using an equipment having only a reduction annealing furnace comprising:

providing a hot-rolled and cold-rolled steel sheet, with said steel sheet containing, by weight:

C: 0.03 to 0.25%,
Si: 0.05 to 2.0%,
Mn: 0.5 to 2.5%,
P: 0.03% or less,
S: 0.02% or less,
Al: 0.01 to 2.0%,
Ni: 0.01 to 0.15%,
Cu: 0.01 to 1.0%,
Sn: 0.01 to 0.10%, and
balance Fe and unavoidable impurities;

with the relationship among Si, Mn and Al satisfying the following expression, $$Si+Al+Mn \geqq 1.0\%;$$

the relationship among Ni, Cu and Sn satisfying the following expression, $$2\times Ni(\%) > Cu(\%)+3\times Sn(\%);$$

the relationship among Si, Al, Ni, Cu and Sn satisfying the following expression, $$Ni(\%)+Cu(\%)+3\times Sn(\%) \geqq \tfrac{1}{5}\times Si(\%)+\tfrac{1}{10}\times Al(\%)$$

regulating an oxygen concentration of 100 ppm or less in a temperature range of lower than 400° C.;

subjecting the steel sheet to a treatment in an atmosphere having an oxygen concentration of 50 ppm or less in a temperature range of 400° C. to 750° C.;

annealing said hot-rolled and cold-rolled steel sheet for 10 sec. to 6 min. in a dual phase coexisting temperature range of 750° C. to 900° C.;

subjecting said steel sheet to another treatment for 30 sec. or longer in a temperature range of 750° C. or higher in an atmosphere wherein hydrogen concentration, dew point and oxygen concentration in said atmosphere are defined by H (%), D (° C.) and O (ppm), respectively, with H, D and O satisfying the following expressions, $$2\ \text{ppm} \leqq O \leqq 30\ \text{ppm, and}$$

$$20\times\exp(0.1\times D) \leqq H \leqq 2{,}000\times\exp(0.1\times D);$$

forming oxides including one or more of Si, Mn and Al and having a length of 3 μm or less on the surface of said steel sheet with an area ratio of 5% to 80%, subsequently cooling said annealed steel sheet to 350° C. to 500° C. at a cooling rate of 2 to 200° C./sec.;

subsequently dipping said cooled steel sheet into a hot-dip galvanizing bath after annealing;

retaining said hot-dip galvanized steel sheet for 5 sec. to 2 min. in a temperature range of 450° C. to 600° C. to form an alloyed hot-dip galvanized layer containing 8 to 15 wt. % Fe on each surface of said steel sheet;

cooling said alloyed hot-dip galvanized steel sheet to 250° C. or lower at a cooling rate of 5° C./sec. or more;

wherein retained austenite in said steel sheet is 2 to 20% by volume ratio.

5. A method for producing a high-strength hot-dip galvanized steel sheet by using an equipment having only a reduction annealing furnace according to claim 1 or 2 further comprising:

after said cooling of said annealed steel sheet to 350° C. to 500° C., retaining said steel sheet in a temperature range of 350° C. to 500° C. for 10 min. or less.

6. A method for producing a high-strength hot-dip galvanized steel sheet by using an equipment having only a reduction annealing furnace according to claim 1 or 3, wherein said steel sheet further contains, by weight, one or more of:

Cu: 0.01 to 1.0%,
Sn: 0.01 to 0.10%,
V: less than 0.3%,
Ti: less than 0.06%,
Nb: less than 0.06%,
B: less than 0.01%,
REM: less than 0.05%,
Ca: less than 0.05%,
Zr: less than 0.05%, and
Mg: less than 0.05%.

7. A method for producing a high-strength hot-dip galvanized steel sheet by using an equipment having only a reduction annealing furnace according to any one of claims 1, 2, 3 and 4, wherein said method further comprises the step of:

subjecting said sheet to a treatment for 30 sec. or longer in a temperature range of 750° C. or higher in an atmosphere wherein hydrogen concentration and dew point in said atmosphere and Ni concentration in said steel sheet are defined by H (%), D (° C.) and Ni (%), respectively, with H, D and Ni satisfying the following expression, $$3\times\exp\{0.1\times(D+20\times(1-Ni(\%)))\} \leqq H \leqq 2{,}000\times\exp\{0.1\times(D+20\times(1-Ni(\%)))\};$$

hot-dip galvanizing said treated steel sheet.

8. A method for producing a high-strength hot-dip galvanized steel sheet by using an equipment having only a reduction annealing furnace according to claim 7, wherein said steel sheet further contains, by weight, one or more of:

V: less than 0.3%,
Ti: less than 0.06%,
Nb: less than 0.06%,
B: less than 0.01%,
REM: less than 0.05%,
Ca: less than 0.05%,
Zr: less than 0.05%, and
Mg: less than 0.05%.

9. A method for producing a high-strength hot-dip galvanized steel sheet by using an equipment having only a reduction annealing furnace according to claim 2 or 4, wherein said steel sheet further contains, by weight, one or more of:

V: less than 0.3%,
Ti: less than 0.06%,
Nb: less than 0.06%,
B: less than 0.01%,
REM: less than 0.05%,
Ca: less than 0.05%,
Zr: less than 0.05%, and
Mg: less than 0.05%.

10. A method for producing a high-strength hot-dip galvanized steel sheet by using an equipment having only a reduction annealing furnace according to claim 3 or 4 further comprising:

after said cooling of said annealed steel sheet to 350° C. to 500° C., retaining said steel sheet in a temperature range of 350° C. to 500° C. for 10 min. or less.

* * * * *